US008946138B2

(12) United States Patent
Kessler et al.

(10) Patent No.: US 8,946,138 B2
(45) Date of Patent: Feb. 3, 2015

(54) METERING CARTRIDGE FOR A WATER-CONDUCTING DOMESTIC APPLIANCE

(75) Inventors: Arnd Kessler, Monheim am Rhein (DE); Thorsten Bastigkeit, Wuppertal (DE); Christian Nitsch, Duesseldorf (DE); Salvatore Fileccia, Oberhausen (DE); Erik Brueckner, Hilden (DE)

(73) Assignee: Henkel AG & Co. KGaA, Duesseldorf (DE)

( * ) Notice: Subject to any disclaimer, the term of this patent is extended or adjusted under 35 U.S.C. 154(b) by 338 days.

(21) Appl. No.: 13/590,313

(22) Filed: Aug. 21, 2012

(65) Prior Publication Data

US 2013/0137621 A1 May 30, 2013

Related U.S. Application Data

(63) Continuation of application No. PCT/EP2010/062114, filed on Aug. 19, 2010.

(30) Foreign Application Priority Data

Feb. 22, 2010 (DE) ..... 10 2010 002 196

(51) Int. Cl.
*A47L 15/44* (2006.01)
*B65D 83/00* (2006.01)
(Continued)

(52) U.S. Cl.
CPC ..... *B65D 83/00* (2013.01); *C11D 3/386* (2013.01); *A47L 15/4445* (2013.01); *A47L 15/4463* (2013.01); *A47L 15/4472* (2013.01); *D06F 39/024* (2013.01)
USPC ..... 510/220; 510/221; 510/226; 510/293; 222/129; 222/325

(58) Field of Classification Search
CPC .... A47L 15/44; A47L 15/4463; B65D 81/18; B65D 83/00; C11D 3/386
USPC ..... 510/200, 221, 226, 293, 392; 222/192, 222/325
See application file for complete search history.

(56) References Cited

U.S. PATENT DOCUMENTS

2005/0139608 A1* 6/2005 Muehlhausen et al. ..... 222/94
2005/0148479 A1 7/2005 Barthel et al.
(Continued)

FOREIGN PATENT DOCUMENTS

WO 2008034697 A1 3/2008
WO 2010006761 A2 1/2010
WO 2010007052 A2 1/2010

OTHER PUBLICATIONS

PCT International Search Report (PCT/EP2010/062114) dated Jan. 13, 2011.

*Primary Examiner* — Gregory Webb
(74) *Attorney, Agent, or Firm* — Thomas G. Krivulka

(57) ABSTRACT

A cartridge, in particular for use in water-conveying household appliances, encompassing an enzyme-containing preparation that contains at least one enzyme protein and has a specific heat capacity $c_p$ at 20° C. of less than 3.8 J/(g*K), preferably less than 3.0 J/(g*K), and is stocked in a cartridge or cartridge chamber having an internal volume of between 20 and 500 ml and an average wall thickness of between 0.1 and 2 mm, and the cartridge material has a specific heat capacity $c_p$ at 20° C. of between 1 and 2 J/(g*K), preferably between 1.15 and 1.9 J/(g*K), particularly preferably between 1.5 and 1.8 J/(g*K).

16 Claims, 23 Drawing Sheets

(51) Int. Cl.
*D06F 39/02* (2006.01)
*C11D 3/386* (2006.01)

(56) References Cited

U.S. PATENT DOCUMENTS

2011/0180118 A1* 7/2011 Schrott ..... 134/56 D
2011/0265829 A1* 11/2011 Catlin et al. ..... 134/25.2
2011/0284032 A1* 11/2011 Souter ..... 134/18
2011/0290281 A1* 12/2011 Kessler et al. ..... 134/18
2012/0021965 A1* 1/2012 Bastigkeit et al. ..... 510/393
2012/0031930 A1* 2/2012 Fileccia et al. ..... 222/325
2013/0133700 A1* 5/2013 Classen et al. ..... 134/25.2
2013/0149770 A1* 6/2013 Cascao-Pereira et al. .... 435/202
2014/0084024 A1* 3/2014 Benda et al. ..... 222/113

* cited by examiner

METERING CARTRIDGE FOR A WATER-CONDUCTING DOMESTIC APPLIANCE

CROSS-REFERENCES TO RELATED APPLICATIONS

This application is a continuation of PCT/EP2010/062114, filed on Aug. 19, 2010, which claims priority under 35 U.S.C. §119 to DE 10 2010 002 196.2 filed on Feb. 22, 2010, both of which are hereby incorporated by reference.

FIELD OF THE INVENTION

The present invention generally relates to a cartridge for use in water-conveying household appliances, encompassing at least one enzyme-containing preparation.

BACKGROUND OF THE INVENTION

Dishwashing agents are available to consumers in a large number of presentation forms. In addition to the traditional liquid hand dishwashing agents, automatic dishwashing agents especially have particular significance now that household automatic dishwashers are widespread. These automatic dishwashing agents are offered to the consumer typically in solid form, for example as powders or tablets, but increasingly also in liquid form. Emphasis has for some time been placed principally on convenient dispensing of washing and cleaning agents, and on simplification of the working steps necessary for carrying out a washing or cleaning method.

Furthermore, one of the main objectives of manufacturers of automatic cleaning agents is to improve the cleaning performance of these agents, increased attention recently having been paid to cleaning performance in low-temperature cleaning cycles or in cleaning cycles having reduced water consumption. To this end, new ingredients, for example more-effective surfactants, polymers, enzymes or bleaching agents, have preferably been added to the cleaning agents. Because new ingredients are available only to a limited extent, however, and because for environmental and economic reasons the quantity of the ingredients used for each cleaning cycle cannot be arbitrarily increased, there are natural limits to this approach to a solution.

In this connection, apparatuses for multiple dispensing of washing and cleaning agents have very recently come under scrutiny by product developers. With regard to these apparatuses, a distinction may be made between on the one hand dispensing chambers integrated into the automatic dishwasher or textile washing machine, and on the other hand separate devices independent of the automatic dishwasher or textile washing machine. By means of these apparatuses, which contain several times the quantity of cleaning agent required to carry out a cleaning method, washing- or cleaning-agent portions are automatically or semi-automatically dispensed into the interior of a cleaning machine in the course of multiple successive cleaning processes. For the consumer, the need for manual dispensing for each cleaning or dishwashing cycle is eliminated. Examples of such apparatuses are described in European patent application EP 1 759 624 A2 (Reckitt Benckiser) or in German patent application DE 53 5005 062 479 A1 (BSH Bosch and Siemens Hausgeräte GmbH).

A critical problem with regard to the introduction of such dispensing apparatuses into the interior of dishwashers or washing machines is the thermal instability of heat-sensitive preparation constituents that are to be dispensed. Because, in the context of the dispensing apparatuses described, washing and/or cleaning preparations remain in the water-conveying household appliance for a plurality of washing or cleaning cycles, the activity of enzyme proteins in particular can be significantly reduced at temperatures in dishwashing and washing machines from 70° C. to almost 100° C.

Cartridges for dispensing apparatuses of the kind mentioned above, which protect heat-sensitive ingredients by way of insulating features on the cartridge, are known from the existing art. WO 2008 034697 A1, for example, discloses a multi-chamber cartridge that can be coupled to the door of an automatic dishwasher, the cartridge comprising thermal insulation at least in portions in order to protect heat-sensitive ingredients from excessive heat input from the interior of the automatic dishwasher.

A disadvantage of such insulation solutions is that effective insulation significantly increases the overall size of a cartridge and, depending on the insulation material selected, allows manufacturing costs to rise considerably. In addition, the insulation material must be suitable for withstanding the alternating-temperature and moisture conditions that exist, for example, in the interior of a dishwasher.

Accordingly, it is desirable to furnish a cartridge that can be manufactured economically and simply, and in which heat-sensitive preparations, in particular enzymes, can be stocked in substantially stable fashion in the interior of a water-conveying household appliance.

This object is achieved by a cartridge that is suitable in particular for use in water-conveying household appliances, encompassing an enzyme-containing preparation that contains at least 0.8 wt % of at least one enzyme protein, preferably at least 1.2 wt % of at least one enzyme protein, and has a specific heat capacity $c_p$ at 20° C. of less than 3.8 J/(g*K), preferably less than 3.0 J/(g*K), and is stocked in a cartridge or cartridge chamber having an internal volume of between 20 and 500 ml and an average wall thickness of between 0.1 and 2 mm, and the cartridge material has a specific heat capacity $c_p$ at 20° C. of between 1 and 2 J/(g*K), preferably between 1.15 and 1.9 J/(g*K), particularly preferably between 1.5 and 1.8 J/(g*K).

Furthermore, other desirable features and characteristics of the present invention will become apparent from the subsequent detailed description of the invention and the appended claims, taken in conjunction with the accompanying drawings and this background of the invention.

BRIEF SUMMARY OF THE INVENTION

A cartridge, in particular for use in water-conveying household appliances, encompassing an enzyme-containing preparation that contains at least one enzyme protein and has a specific heat capacity $c_p$ at 20° C. of less than 3.8 J/(g*K), preferably less than 3.0 J/(g*K), and is stocked in a cartridge or cartridge chamber having an internal volume of between 20 and 500 ml and an average wall thickness of between 0.1 and 2 mm, and the cartridge material has a specific heat capacity $c_p$ at 20° C. of between 1 and 2 J/(g*K), preferably between 1.15 and 1.9 J/(g*K), particularly preferably between 1.5 and 1.8 J/(g*K).

BRIEF DESCRIPTION OF THE DRAWINGS

The present invention will hereinafter be described in conjunction with the following drawing figures, wherein like numerals denote like elements, and FIG. 1 Autonomous dispenser having a two-chamber cartridge, in the separated and the assembled state.

DETAILED DESCRIPTION OF THE INVENTION

Figure 1:
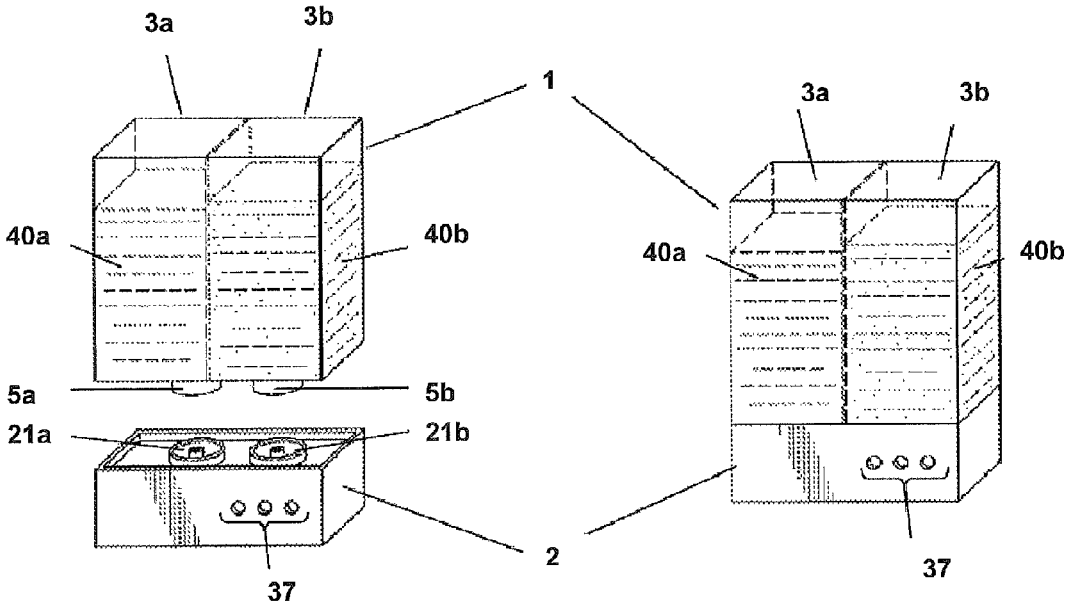

The following detailed description of the invention is merely exemplary in nature and is not intended to limit the invention or the application and uses of the invention. Furthermore, there is no intention to be bound by any theory presented in the preceding background of the invention or the following detailed description of the invention.

In contradiction to the opinion held in the existing art that a cartridge must be insulated as effectively as possible, it has now been found, surprisingly, that the heat-sensitive enzymes substantially maintain their activity, even in the interior of a water-conveying household appliance, if the cartridge as well as the heat-sensitive enzyme preparation have a low specific heat capacity, i.e. can heat up and cool down quickly.

The invention thus has the advantage of eliminating expensive and structurally complex insulating features and nevertheless guaranteeing sufficiently good thermal stability of, in particular, enzyme proteins.

In a preferred embodiment of the invention, one or more enzyme protein(s) are selected from the group of the amylases, proteases, cellulases, mannanase, polyesterases, xylanases, carrageenases, perhydrolases, pectinases, pectatelyases, oxidases, for example glycose oxidases, and/or lipases.

It is further preferred that at least two, in particular three to four chambers be provided in or on a cartridge, preparations differing from one another being stocked in the chambers, and at least one chamber containing an enzyme protein.

It is particularly to be preferred that the enzyme protein-containing chamber be arranged between two further chambers of the cartridge. This means that the enzyme protein-containing chamber has in each case at least one contact surface with an adjacent chamber.

It is very particularly preferred that the enzyme protein-containing chamber be embodied in terms of its internal volume to be smaller or equal in size with reference to the respectively adjacent chamber.

The internal volume of at least one of the chambers that contains no enzyme protein is by preference greater than the internal volume of the chamber that contains enzyme protein. In such a case, the internal volume ratio of the chamber that contains enzyme protein to the chamber that contains no enzyme protein is by preference equal to between 1:1.2 and 1:40, preferably between 1:1.5 and 1:20, and in particular between 1:2 and 1:10.

An embodiment in which the cartridge comprises at least two, in particular three to four chambers is therefore particularly preferred, preparations differing from one another being stocked in the chambers, and at least one chamber containing an enzyme protein that comprises at least one contact surface with an adjacent chamber, where the enzyme-containing preparation contains at least 0.8 wt % of at least one enzyme protein, preferably at least 1.2 wt % of at least one enzyme protein, and has a specific heat capacity $c_p$ at 20° C. of less than 3.8 J/(g*K), preferably less than 3.0 J/(g*K), and is stocked in a cartridge chamber having an internal volume of between 20 and 500 ml and an average wall thickness of between 0.1 and 2 mm, and the cartridge material has a specific heat capacity $c_p$ at 20° C. of between 1 and 2 J/(g*K), preferably between 1.15 and 1.9 J/(g*K), particularly preferably between 1.5 and 1.8 J/(g*K); and the internal volume ratio of the chamber that contains enzyme protein to the chamber that contains no enzyme protein is equal to by preference between 1:1.2 and 1:40, preferably between 1:1.5 and 1:20, and in particular between 1:2 and 1:10.

In accordance with a further preferred embodiment of the invention, the material(s) of the chamber(s) that contain(s) no enzyme protein has/have a specific heat capacity $c_p$ at 20° C. of between 1 and 2 J/(g*K), the cartridge chamber(s) having in particular an internal volume of between 20 and 500 ml, and in particular an average wall thickness of between 0.1 and 2 mm.

An embodiment in which the cartridge comprises at least two, in particular three to four chambers is therefore particularly preferred, preparations differing from one another being stocked in the chambers, and at least one chamber containing an enzyme protein that comprises at least one contact surface with an adjacent chamber that contains no enzyme protein, where the enzyme-containing preparation contains at least 0.8 wt % of at least one enzyme protein, preferably at least 1.2 wt % of at least one enzyme protein, and has a specific heat capacity $c_p$ at 20° C. of less than 3.8 J/(g*K), preferably less than 3.0 J/(g*K), and is stocked in a cartridge chamber having an internal volume of between 20 and 500 ml and an average wall thickness of between 0.1 and 2 mm, and the cartridge material has a specific heat capacity $c_p$ at 20° C. of between 1 and 2 J/(g*K), preferably between 1.15 and 1.9 J/(g*K), particularly preferably between 1.5 and 1.8 J/(g*K);

the further chamber that contains no enzyme protein has a specific heat capacity $c_p$ at 20° C. of between 1 and 2 J/(g*K), the further cartridge chamber or at least one of the further cartridge chambers having an internal volume greater than the internal volume of the chamber having the enzyme protein; and the internal volume ratio of the chamber that contains enzyme protein to the chamber that contains no enzyme protein is equal to by preference between 1:1.2 and 1:40, preferably between 1:1.5 and 1:20, and in particular between 1:2 and 1:10.

In the context of multi-chamber cartridges it is furthermore advantageous that the preparation(s) in the chamber(s) that contain(s) no enzyme protein have a specific heat capacity $c_p$ at 20° C. of less than 3.8 J/(g*K), preferably less than 3.0 J/(g*K).

It is furthermore to be preferred that the preparations in the chamber(s) that contain(s) no enzyme protein are one or more preparation(s) selected from the group of the bleach-containing preparations, surfactant-containing preparations, rinse aid-containing preparations, fabric softener-containing preparations, and/or scent preparations.

In an advantageous refinement of the invention, the cartridge is embodied in substantially plate-like fashion. Advantageously, the cartridge has a ratio of the depth (T) of the cartridge to the width (B) of the cartridge of approximately at least 1:5, preferably at least 1:10, particularly preferably at least 1:20.

It is further preferred that the chambers of the cartridge be arranged substantially next to one another. It is preferred in this context that the chambers be arranged along a straight line. It is further preferred in this context that the width (B) of the chambers be in each case greater than the depth (T) of the chambers.

In order to make the fill level visible to the user, it is advantageous if the cartridge is made, at least in portions, of a substantially transparent plastic. It has been found that the transparency of the cartridge has a positive influence on thermal stability of the ingredients.

It has further been found that the transparency of the preparation has a positive influence on the thermal stability of the ingredients, so that it is to be preferred that the preparations stocked in the cartridge be substantially transparent.

In order to avoid improper operation of the cartridge, it is advantageous that the cartridge be embodied asymmetrically, in such a way that the cartridge is couplable to a corresponding dispenser only in one predefined position.

The cartridge according to the present invention can be configured in particular for use in a dishwasher, laundry dryer, and/or washing machine.

Cartridge

For purposes of this application, a "cartridge" is understood as a packaging means that is suitable for encasing or holding together at least one flowable, pourable or scatterable preparation, and is couplable to a dispenser in order to deliver at least one preparation.

In the simplest conceivable embodiment, the cartridge comprises a (preferably dimensionally stable) chamber for stocking a preparation. In particular, a cartridge can also encompass multiple chambers that are finable with compositions differing from one another.

It is advantageous for the cartridge to comprise at least one outlet opening which is arranged such that gravity-effected release of preparation from the cartridge can be brought about when the dispenser is in the service position. As a result, no further conveying means are required for the release of preparation from the cartridge, so that the construction of the dispenser can be kept simple and manufacturing costs low. The use of conveying means such as, for example, pumps can also be omitted, with the result that the service life of a battery or rechargeable battery of the dispenser can be lengthened.

In a preferred embodiment of the invention, at least one second chamber is provided for receiving at least one second flowable or scatterable preparation, the second chamber comprising at least one outlet opening which is arranged such that a gravity-effected product release from the second chamber can be brought about when the dispenser is in the service position. The arrangement of a second chamber is particularly advantageous when preparations that are not usually shelf-stable with one another, for example bleaching agents and enzymes, are stocked in the chambers of the cartridge that are separated from one another.

It is furthermore conceivable for more than two, in particular three to four chambers to be provided in or on a cartridge. In particular, one of the chambers can be configured for the delivery of volatile preparations, for instance a scent, into the environment.

In a further embodiment of the invention, the cartridge is embodied in one piece. As a result, the cartridges can be embodied economically in one manufacturing step, in particular using suitable blow molding methods. The chambers of a cartridge can in this context be separated from one another by, for example, webs or material bridges that are shaped during or after the blowing process.

The cartridge can also be formed from multiple pieces, using components manufactured by injection molding and then joined together.

It is furthermore conceivable for the cartridge to be shaped in multi-piece fashion such that at least one chamber, preferably all the chambers, are individually removable from or insertable into the dispenser. This makes it possible, if a preparation from one chamber is consumed at a different rate, to replace an already empty chamber while the others, which may still be filled with preparation, remain in the dispenser. Targeted and demand-compatible refilling of the individual chambers or with their preparations can thereby be achieved. It is additionally conceivable to construct the individual chambers in such a way that the chambers can be coupled to one another or to the dispenser in only in one specific position or location, thereby preventing a user from connecting a chamber to the dispenser in a position not intended for said chamber. To that end, the chamber walls can in particular be shaped in such a way that they can be positively connected to one another. It is particularly advantageous, in the case of a cartridge formed from at least three chambers, to shape the cartridges such that the chambers can be connected positively to one another only in a specific defined position.

The chambers of a cartridge can be fastened to one another using suitable connection methods, thereby forming a container unit. The chambers can be fastened detachably or non-detachably to one another by a suitable positive, frictionally engaged, or materially attached connection. In particular, fastening can be effected by one or more of the connection types from the group of the snap-in connections, hook-and-loop connections, press connections, melt connections, adhesive connections, weld connections, solder connections, screw connections, keyed connections, clamp connections, or flip-closure connections. In particular, fastening can also be embodied by a heat-shrink sleeve, which in a heated state is pulled over all or portions of the cartridge, and in the cooled state fixedly surrounds the chambers or the cartridge.

In order to provide advantageous residual emptying properties for the chambers, the bottom of the chambers can be inclined in a funnel shape toward the delivery opening. Moreover, the inner wall of a chamber can be embodied, by suitable material selection and/or surface configuration, in such a way that little material adhesion of the preparation onto the internal chamber wall occurs. This action, too, allows the residual emptying capability of a chamber to be further optimized.

In particular, the cartridge can also be embodied asymmetrically. It is particularly preferred to configure the asymmetry of the cartridge such that the cartridge is couplable to the dispenser only in a predefined position, thereby preventing incorrect operation by the user which would otherwise be possible.

A dispensing chamber can be embodied in or on a chamber before the outlet opening in the gravity-effected flow direction of the preparation. The dispensing chamber defines the quantity of preparation that is to be delivered to the environment upon the release of preparation from the chamber. This is particularly advantageous when the closure element of the dispenser, which brings about delivery of preparation from a chamber to the environment, can be placed only into a delivery state and a closed state, without monitoring or control of the quantity delivered. The dispensing chamber then ensures that a predefined quantity of preparation is released without direct feedback of the quantity of preparation currently being delivered.

The dispensing chambers can be shaped in single- or multi-piece fashion. It is furthermore possible to embody the dispensing chambers in a manner fixedly connected to or detachable from the cartridge. In the case of a dispensing chamber connected detachably to the cartridge, it is easily possible for dispensing chambers having dispensing volumes differing from one another to be connected to a cartridge or interchanged, thereby making possible easy adaptation of the dispensing volumes to the respective preparation stocked in a chamber, and thus easy implementation of the cartridge for different preparations and for dispensing thereof.

According to a further advantageous refinement of the invention, one or several chamber(s) comprise(s), besides a preferably bottom-side outlet opening, a respective preferably top-side second chamber opening that can be closed off in liquid-tight fashion. This chamber opening makes it possible, for example, to replenish a preparation stocked in said chamber.

For venting of the cartridge chambers, venting capabilities can be provided in particular in the top region of the cartridge in order to ensure pressure equalization between the interior of the cartridge chambers and the environment as the fill level of the chambers drops. These venting capabilities can be embodied, for example, as a valve, in particular a silicone valve, micro-openings in a chamber wall or cartridge wall, or the like.

If, according to a further embodiment, the cartridge chambers are vented not directly but rather via the dispenser, or if no venting is provided, for example when using flexible containers such as for example pouches, this has the advantage that at elevated temperatures in the course of a washing cycle of a dishwasher, a pressure is built up due to heating of the chamber contents, which pressure pushes the preparations to be dispensed toward the outlet openings so that a good residual emptying capability for the cartridge is thereby achievable. In addition, with air-free packaging of this kind there is no risk of oxidation of substances of the preparation; this makes a pouch package or even bag-in-bottle package seem useful in particular for oxidation-sensitive preparations.

The volume ratio, calculated from the physical volume of the dispenser and the internal volume of the cartridge, is equal preferably to $<1$, particularly preferably $<0.1$, especially preferably $<0.05$. The result of this is that for a predefined total physical volume of the dispenser and cartridge, the predominant proportion of the physical volume is accounted for by the cartridge and the preparation contained therein.

The cartridge can assume any desired three-dimensional shape. It can for example be cubic, spherical or plate-like in configuration.

The cartridge and the dispenser can in particular be configured, with regard to their three-dimensional shape, in such a way that they ensure the least possible loss of useful volume in particular in an automatic dishwasher.

For utilization of the dispenser in automatic dishwashers, it is particularly advantageous to shape the device by analogy with tableware to be cleaned in automatic dishwashers. It can, for example, be plate-shaped, having approximately the dimensions of a dinner plate. As a result, the dispenser can be positioned in space-saving fashion, for example, in the lower rack of the dishwasher. Furthermore, correct positioning of the dispensing unit is immediately and intuitively evident to the user thanks to the plate-like shape.

The cartridge and the dispenser, in the state coupled to one another, preferably have a ratio of height to width to depth of between 5:5:1 and 50:50:1, particularly preferably approximately 10:10:1. The "slender" embodiment of the dispenser and the cartridge makes it possible in particular to position the device in the lower loading rack of an automatic dishwasher in the receptacles provided for plates. This has the advantage that the preparations delivered from the dispenser travel directly into the washing bath and cannot adhere to other items being washed.

Commercially usual household automatic dishwashers are usually designed so that provision is made to arrange larger items to be washed, for instance pans or large plates, in the lower rack of the automatic dishwasher. In order to prevent the user from positioning the dispensing system, made up of the dispenser and the cartridge coupled to the dispenser, less than optimally in the upper rack, in an advantageous embodiment of the invention the dispensing system is dimensioned so as to enable the dispensing system to be positioned only in the receptacles of the lower rack provided therefor. To this end, the width and height of the dispensing system can be selected to be, in particular, between 150 mm and 300 mm, particularly preferably between 175 mm and 250 mm.

A further advantage of a flat, plate-shaped embodiment of the cartridge may be seen in the fact that, as a result of a relatively high surface to volume ratio, the stocked liquids heat up and cool down again quickly.

It is also conceivable, however, to embody the dispensing unit and/or the cartridge in a cup shape or pot shape, with a substantially circular or square base outline.

The outlet openings of a cartridge are preferably arranged on one line, thus enabling a slender, plate-shaped embodiment of the dispenser.

In the case of a pot- or cup-shaped embodiment of the cartridge or a pot- or cup-shaped grouping thereof, it can also be advantageous to arrange the delivery openings of the cartridge, for example, in the form of a circular arc.

In order to make available direct visual fill level monitoring, it is advantageous to shape the cartridge at least in portions from a transparent material.

The cartridge is embodied, in particular, in dimensionally stable fashion. It is also conceivable, however, to configure the cartridge as a flexible packaging means, for instance as a tube. It is furthermore also possible to use flexible containers such as pouches, in particular if they are used in a substantially dimensionally stable receiving vessel in accordance with the "bag-in-bottle" principle. In contrast to the above-described dimensionally stable cartridge embodiments, the use of flexible packaging means eliminates the need to provide a venting system for pressure equalization.

In order to preclude incorrect use of the cartridge, the cartridges can also comprise structural elements that interact with corresponding elements of the dispenser on the lock-and-key principle, so that for example only cartridges of a specific type can be coupled onto the dispenser. This embodiment furthermore makes it possible for information about the cartridge coupled to the dispenser to be transmitted to the control unit of the dispenser, with the result that the dispensing apparatus can be controlled in a manner coordinated with the contents of the corresponding container.

The cartridge is embodied in particular for the reception of flowable washing or cleaning agents. Particularly preferably, a cartridge of this kind comprises a plurality of chambers for spatially separated reception of preparations of a washing or cleaning agent that each differ from one another. By way of example, but not exhaustively, some possible combinations for filling the chambers with different preparations are listed below:

| | Chamber 1 | Chamber 2 | Chamber 3 | Chamber 4 |
|---|---|---|---|---|
| A | Alkaline cleaning preparation | Enzymatic cleaning preparation | — | — |
| B | Alkaline cleaning preparation | Enzymatic cleaning preparation | Rinse aid | — |
| C | Alkaline cleaning preparation | Enzymatic cleaning preparation | Rinse aid | Scent |
| D | Alkaline cleaning preparation | Enzymatic cleaning preparation | Rinse aid | Disinfectant preparation |
| E | Alkaline cleaning preparation | Enzymatic cleaning preparation | Rinse aid | Pretreatment preparation |

It is particularly preferred that all preparations be flowable, since this ensures, for example, rapid dissolution of the preparations in the washing bath of the washing machine, with the result that these preparations achieve a rapid to immediate cleaning effect.

The cartridge usually has a total internal volume of <5000 ml, in particular <1000 ml, preferably <500 ml, particularly preferably <250 ml, very particularly preferably <50 ml.

It is preferred that the enzyme chamber of the cartridge have an internal volume of between 20 and 500 ml.

The chambers of a cartridge can have internal volumes that are identical to or differ from one another. In the case of a configuration having two chambers, the ratio of chamber volumes is preferably 5:1, for a configuration having three chambers preferably 4:1:1, these configurations being suitable in particular for use in automatic dishwashers.

As mentioned above, the cartridge preferably possesses three chambers. For use of a cartridge of this kind in an automatic dishwasher, it is particularly preferred that one chamber contain an alkaline cleaning preparation, a further chamber an enzymatic preparation, and a third chamber a rinse aid, the volume ratio of the chambers being equal to approximately 4:1:1.

The chamber containing the alkaline cleaning preparation preferably has the largest internal volume of the chambers that are present. The chambers that stock an enzymatic preparation or a conditioner preferably have approximately the same internal volumes.

In the case of a two- and/or three-chamber embodiment of the cartridge, it is possible in particular to stock, in particular, a scent preparation, disinfectant preparation, and/or pretreatment preparation in a further chamber arranged detachably on the cartridge or on the dispenser.

The cartridge encompasses a cartridge bottom that, in the service position, is directed downward in the direction of gravity, and on which at least one outlet opening arranged at the bottom in the direction of gravity is preferably provided for each chamber. The outlet openings arranged at the bottom are, in particular, embodied in such a way that at least one outlet opening, preferably all outlet openings, are communicatively connectable to the inlet openings of the dispensing unit, i.e. preparation can flow through the outlet openings out of the cartridge into the dispenser, preferably under the influence of gravity.

It is also conceivable for one or more chambers to have an outlet opening not arranged at the bottom in the direction of gravity. This is advantageous in particular when, for example, a scent is to be delivered into the environment of the cartridge.

The cartridge is preferably constituted from at least two elements connected by material attachment to one another, such that the connecting edge of the elements on the cartridge bottom extends outside the outlet openings, i.e. the connecting edge does not intersect the outlet openings. This is advantageous in particular because sealing problems in the context of coupling to the dispenser in the region of the outlet openings, which occur in particular in the presence of the large alternating-temperature stresses that usually occur in a dishwasher, can thereby be avoided.

The connection by material attachment can be produced, for example, by adhesive bonding, welding, soldering, pressing, or vulcanizing It is particularly preferred to connect the cartridge elements to one another by mirror welding. In mirror welding, a metal heating mirror that contains the contour of the interfaces that are to be connected is used to heat the interfaces and bring them briefly into the plastic state, so that after the heating mirror is removed and the parts are joined together, these plastic regions solidify again from the melt and produce a strong connection.

In addition to the minor welding technique known from the existing art, individually injection-molded parts can, for example, also be connected to one another by laser welding. In laser welding, one of the two materials that are to be melted at the interface must carry an absorbent in order to receive the energy content of the laser beam and convert it into heat, which then produces melting of the corresponding material region. This is typically achieved using color pigments that enter into a thermal interaction with the laser beam guided into the material. These interfaces to be joined can also be covered, if the material present in front of them in the laser beam irradiation direction is transparent to the laser beam and has no absorption property.

It is furthermore possible to connect individual cartridge elements by means of ultrasonic welding methods or IR welding using electrodes.

It is advantageous that the connecting edge extends along the top, bottom, and side surfaces of the cartridge. As a result, two cartridge elements can be manufactured in particular using the injection molding method, such that either both elements are embodied in trough-shaped fashion, or one element is trough-shaped and the second element is similar to a cover.

To constitute a two- or multi-chamber cartridge, at least one of the two cartridge elements can encompass at least one separating web that, when the elements are joined together, separates each two adjacent chambers of the cartridge from one another.

As an alternative to embodying the cartridge from two shell-shaped cartridge elements, it is also conceivable for one cartridge element to be a cell-like container having at least one chamber, and the second element to be the cartridge bottom or top that is connected to the cell-like container in liquid-tight fashion along the connecting edge.

It is of course also conceivable to combine the aforementioned cartridge configurations in any suitable manner. For example, it is possible to form a two-chamber cartridge from one trough-shaped and one cover-like cartridge element, and to arrange a third single- or multi-piece chamber on the top or on the enveloping surface of the cartridge thus formed.

In particular, a further chamber of this kind for receiving a preparation can be arranged on the cartridge and configured so as to bring about a delivery of volatile substances, for example scents, from the preparation into the environment of the chamber.

According to a preferable embodiment, the outlet openings of the cartridge are closed off by closure means at least when the cartridge is in the filled, unopened state. The closure means can be embodied such that they permit one-time opening of the outlet opening by destruction of the closing means. Such closure means are, for example, sealing films or closure caps.

According to a preferable embodiment of the invention, the outlet openings are each equipped with a closure that, in the state coupled to a dispenser, allows preparation to flow out of the respective chambers and, when the cartridge is in the uncoupled state, substantially prevents an outflow of preparation. A closure of this kind is configured in particular as a silicone slit valve.

It is furthermore preferred that the vent openings of the cartridge be closed off with a closure element before a first coupling to the dispenser. The closure element can in particular be a plug or cap that is opened, for example penetrated, by the coupling process upon first coupling to the dispenser.

It is very particularly preferred that prior to a first coupling of the cartridge to the dispenser, all outlet openings of the cartridge be closed off with a silicone slit valve, and all vent openings with a cap.

The cartridge elements forming the cartridge are preferably formed from a plastic, and can be shaped in a shared injection molding process; it may be advantageous in this context to shape on between the two elements a connecting web acting as a hinge, so that after shaping, the two elements are butted against another by folding over, and are connected by material attachment along the connecting edge.

In a further embodiment of the invention, an energy source, in particular a battery or rechargeable battery, is arranged on or in the cartridge, preferably on or in the bottom of the cartridge. Means for electrically coupling the energy source to the dispenser can furthermore be provided on the cartridge.

In a further, preferred embodiment of the invention, the cartridge for coupling to a dispenser, positionable in the interior of a household appliance, for delivering at least one washing- and/or cleaning-agent preparation, comprises at least one chamber for stocking at least one flowable or pourable washing- and/or cleaning-agent preparation, the cartridge being, in the state coupled to the dispenser, protected from the entry of washing water into the chamber(s), and the cartridge encompassing at least one delivery opening, on the bottom side in the direction of gravity, for (in particular, gravity-effected) delivery of preparation out of at least one chamber, and encompassing at least one vent opening, on the bottom side in the direction of gravity, for venting at least one chamber, the vent opening being separated from the delivery opening and the vent opening being communicatively connected to at least one chamber of the cartridge.

It is particularly preferred for the cartridge to encompass at least two chambers, very particularly preferably at least three chambers. It is advantageous here that one vent opening and one delivery opening are respectively provided for each chamber.

It is furthermore preferred that the bottom-side vent opening be connected communicatively to a vent conduit whose end facing away from the vent opening terminates, when the cartridge coupled to the dispenser is in the delivery position, above the maximum fill level of the cartridge.

It is advantageous in this context that the vent conduit is shaped entirely or partly into or onto the walls and/or webs of the cartridge. In particular, the vent conduit can be shaped integrally into or onto the walls and/or webs of the cartridge.

For this purpose, the vent conduit can advantageously be formed by joining at least two elements forming the cartridge. For example, a vent conduit can be formed by joining a separating web of the cartridge, shaped in the shell-shaped element, to two webs that are arranged on the cartridge element and enclose the separating web.

It is advantageous in this context if the vent conduit is formed by joining by material attachment, in particular by welding, a separating web of the cartridge, shaped in the shell-shaped element, to two webs that are arranged on the cartridge element and enclose the separating web.

Alternatively thereto, the vent conduit can also be embodied, for example, as a so-called dip tube.

In order to ensure venting of the cartridge even in an oblique position, for example when the dispenser is placed in the plate receptacle, it is advantageous that the fill level (F) of the cartridge is not present at the vent conduit orifice (83) in an oblique position of up to 45° when the cartridge is in the unopened, filled state.

It is furthermore advantageous in this context to arrange the vent conduit orifice approximately centered on or in the chamber wall of the cartridge top.

In order to ensure functionality, for example, even following a horizontal position of the cartridge, it is advantageous if the vent conduit, and the viscosity of a flowable preparation, are configured in such a way that the preparation is not drawn into the vent conduit by capillary forces when the preparation is present at the vent conduit orifice.

Coupling of the cartridge to the dispenser is advantageously to be configured so that there is arranged on the dispenser a peg, communicatively connected to the inlet opening of the dispenser, that interacts with the couplable cartridge or cartridge chamber in such a way that upon coupling of the vent opening of the cartridge or cartridge chamber to the dispenser, the peg displaces a volume Δv in the vent conduit, thereby generating in the vent conduit a pressure Δp that is suitable for transporting flowable preparation present in the vent conduit into the chamber that stocks preparation and is connected to the vent conduit.

It is preferred that the vent opening of a chamber be communicatively connected, using the dispenser-side peg, before the closed-off outlet opening of the corresponding chamber is opened, for example by communicative connection to the inlet opening of the dispenser.

According to a further advantageous embodiment of the invention, a vent chamber is arranged between the vent opening and the vent conduit.

The cartridge can be embodied so that it can be arranged detachably or fixedly in or on the dispenser and/or on an automatic dishwasher or a washing machine and/or a clothes dryer.

In a further, advantageous embodiment of the invention, the dispenser for delivering at least one flowable washing- and/or cleaning-agent preparation into the interior of a household appliance encompasses a cartridge couplable to the dispenser, the cartridge stocking at least one flowable washing- and/or cleaning-agent preparation and the cartridge comprising, at the bottom in the direction of gravity, at least one outlet opening that, in the state coupled to the dispenser, is connected communicatively to an inlet opening of the dispenser, the dispenser and the cartridge comprising means which interact in such a way that a detachable latching engagement is producible between the dispenser and cartridge, the dispenser and the cartridge being, in the latched state, pivotable with respect to one another about a pivot point (SP); and that the outlet opening of the cartridge and the inlet opening of the dispensing bracket are configured such that they are connected communicatively, once latching has been established between the cartridge and dispenser, by pivoting the cartridge into the coupled state between the dispensing bracket and cartridge.

In particular, it is preferred that the outlet openings of the chambers and the inlet openings of the dispenser be arranged and configured in such a manner that they become connected to one another sequentially by pivoting the dispenser and cartridge, in the latched state, into the coupled state.

According to a further advantageous embodiment, means can be embodied on the dispenser and/or the cartridge which, in the coupled state of the dispenser and cartridge, bring about detachable fastening of the cartridge on the dispenser.

It is also advantageous to embody, on the dispenser and/or cartridge, means which, with the cartridge and dispenser in the latched state, bring about guidance of the cartridge upon pivoting into the coupled state of the cartridge and dispenser. This can be achieved, for example, by a collar extending on the bottom side of the cartridge, which collar is slightly set back with respect to a corresponding dispenser-side collar, so that the cartridge-side collar is guided inside the dispenser-side collar.

It is advantageous in particular that the outlet openings of the chambers are arranged behind one another in a pivoting direction. It is very particularly preferred that the outlet openings of the chambers be arranged on one line (L) in a pivoting direction.

It is furthermore advantageous that the outlet openings of the chambers are at approximately the same distance from one another.

In a further, advantageous embodiment of the invention, the greatest distance of an outlet opening of a chamber from the pivot point (SP) of the cartridge is approximately 0.5 times the cartridge width (B).

In particular, at least two chambers of the cartridge can have volumes differing from one another.

Advantageously, that chamber of the cartridge which has the greatest volume is at the greatest distance from the pivot point (SP) of cartridge 1.

In a further embodiment of the invention, the vent opening of a chamber is located, in a pivot direction upon coupling of the cartridge to the dispenser, in each case before an outlet opening of the chamber.

The ratio of the depth (T) of the cartridge to the width (W) of the cartridge is preferably approximately 1:20. The ratio of the height (H) of the cartridge to the width (B) of the cartridge is preferably approximately 1:1.2.

It is likewise preferred that the vent opening of a cartridge be located, in a pivot direction upon coupling of the cartridge to the dispenser, in each case before an outlet opening of the chamber. This ensures that upon coupling of the cartridge to the dispenser, the vent opening of the cartridge is opened first, before opening of the outlet opening of the cartridge.

Enzyme-containing Preparation

An "enzyme" is to be understood for purposes of the present application as a protein that performs a specific biocatalytic function.

At least one enzyme protein is present in an "enzyme-containing preparation" for purposes of this application. It is also possible to use commercially obtainable liquid or solid enzyme preparations that contain an enzyme protein.

In a preferred embodiment, the enzyme is a hydrolytic enzyme. In a further preferred embodiment of the invention, the enzyme is a hydrolase (EC 3.X.X.X). A hydrolase is an enzyme that hydrolytically cleaves esters, ethers, peptides, glycosides, acid anhydrides, or C—C bonds in a reversible reaction. The hydrolytic enzyme therefore catalyzes the hydrolytic cleavage of substances as defined by: A-B=$H_2O$<->AH+B-OH. Hydrolases form the third main class in the EC classification of enzymes. The EC (Enzyme Commission) numbers constitute a numerical classification system for enzymes. Each EC number is made up of four numbers separated by periods; the first digit identifies one of the six main enzyme classes, and hydrolases (EC 3.X.X.X) correspondingly represent the third main class. Its representatives are proteases, peptidases, nucleases, phosphatases, glycosidases, and esterases. A particularly preferred hydrolase is selected from the group consisting of protease, amylase, cellulase, hemicellulase, in particular mannanase and/or pectinase, tannase, xylanase, xanthanase, β-glucosidase, carrageenase, lipase, esterases, or mixtures thereof. Preferred proteases are serine proteases, more preferably subtilases, and particularly preferably subtilisins.

Examples of proteases are the subtilisins BPN from *Bacillus amyloliquefaceans* and Carlsberg from *Bacillus licheniformis*, protease PB92, subtilisins 147 and 309, the protease from *Bacillus lentus*, subtilisin DY, and the enzymes (to be classified, however, as subtilases and no longer as subtilisins in the strict sense) thermitase, proteinase K, and the proteases TW3 and TW7. Subtilisin Carlsberg is obtainable in further developed form under the trade name Alcalase® from Novozymes A/S, Bagsvaerd, Denmark. Subtilisins 147 and 309 are marketed by Novozymes under the trade names Esperase® and Savinase®, respectively. The protease variants listed under the designation SLAP® are derived from the protease from *Bacillus lentus* DSM 5483. Other usable proteases are, for example, the enzymes obtainable under the trade names Durazym®, Relase®, Everlase®, Nafizym®, Natalase®, Kannase®, and Ovozyme® from Novozymes, under the trade names Purafect®, Purafect® OxP, Purafect® Prime, Excellase®, and Properase® from Danisco/Genencor, under the trade name Protosol® from Advanced Biochemicals Ltd., Thane, India, under the trade name Wuxi® from Wuxi Snyder Bioproducts Ltd., China, under the trade names Proleather® and Protease P® from Amano Pharmaceuticals Ltd., Nagoya, Japan, and under the designation Proteinase K-16 from Kao Corp., Tokyo, Japan. The proteases from *Bacillus gibsonii* and *Bacillus pumilus*, which are disclosed in international patent applications WO 08/086,916 and WO 07/131,656, are also used with particular preference. Further advantageously usable proteases are disclosed in patent applications WO 91/02792, WO 08/007,319, WO 93/18140, WO 01/44452, GB 1243784, WO 96/34946, WO 02/029024, and WO 03/057246. Further usable proteases are those that are naturally present in the microorganisms *Stenotrophomonas maltophilia*, in particular *Stenotrophomonas maltophilia* K279a, *Bacillus intermedius*, and *Bacillus sphaericus*.

Examples of amylases are the ⟨-amylases from *Bacillus licheniformis*, from *Bacillus amyloliquefaciens*, or from *Bacillus stearothermophilus*, and in particular the further developments thereof improved for use in washing or cleaning agents. The enzyme from *Bacillus licheniformus* is available from the Novozymes company under the name Termarnyl®, and from Danisco/Genencor under the name Purastar® ST. Further developed products of this ⟨-amylase are available from Novozymes under the trade names Duramyl® and Termamyl® ultra, from Danisco/Genencor under the name Purastar® OxAm, and from Daiwa Seiko Inc., Tokyo, Japan, as Keistase®. The ⟨-amylase from *Bacillus amyloliquefaciens* is marketed by Novozymes under the name BAN®, and derived variants of the ⟨-amylase from *Bacillus stearothermophilus* are marketed, again by Novozymes, under the names BSG® and Novamyl®. Additionally to be highlighted for this purpose are the ⟨-amylase from *Bacillus* sp. A 7-7 (DSM 12368) and the cyclodextrin-glucanotransferase (CGTase) from *Bacillus agaradherens* (DSM 9948). Also usable are the amylolytic enzymes that are disclosed in international patent applications WO 03/002711, WO 03/054177, and WO 07/079,938. Fusion products of all the aforesaid molecules are likewise usable. The further developments of the α-amylase from *Aspergillus niger* and *A. oryzae*, obtainable from Novozymes under the trade names Fungamyl®, are also suitable. Further advantageously usable commercial products are, for example, AmylaseLT® and Stainzyme® or Stainzyme Ultra® or Stainzyme Plus®, the latter likewise from Novozymes. Variants of these enzymes obtainable by point mutations can also be used according to the present invention.

Examples of cellulases (endoglucanases, EG) are the fungus-based cellulase preparation rich in endoglucanase (EG), or its further developments, offered by the Novozymes company under the trade name Celluzyme®. The products Endolase® and Carezyme®, likewise obtainable from the Novozymes company, are based on the 50 kD EG and 43 kD EG, respectively, from Humicola insolens DSM 1800. Further usable commercial products of this company are Cellusoft®, Renozyme®, and Celluclean®. Also usable are, for example, the cellulases that are available from the AB Enzymes company, Finland, under the trade names Ecostone® and Biotouch® and that are based at least in part on the 20 kD EGs from Melanocarpus. Other cellulases of the AB Enzymes company are Econase® and Ecopuip®. Other suitable cellulases are from *Bacillus* sp. CBS 670.93 and CBS 669.83, the one from *Bacillus* sp. CBS 670.93 being obtainable from the Danisco/Genencor company under the trade name Puradax®. Other usable commercial products of the Danisco/Genencor company are "Genencor detergent cellulase L" and IndiAge® Neutra.

Further preferred hydrolytic enzymes are those grouped under the term "glycosidases" (EC 3.2.1.X). These include in particular arabinases, fucosidases, galactosidases, galactanases, arabico-galactan-galactosidases, mannanases (also called mannosidases or mannases), glucuronosidases, agarase, carrageenases, pullulanases, β-glucosidases, xyloglucanases (xylanases), and pectin-degrading enzymes (pectinases). Preferred glycosidases are also grouped under the term "hemicellulases." Included among the hemicellulases are, in particular, mannanases, xyloglucanases (xylanases), β-glucosidases, and carrageenases, as well as furthermore pectinases, pullulanases, and β-glucanases. Pectinases are pectin-degrading enzymes, the hydrolytic pectin-degrading enzymes belonging in particular to the enzyme classes EC 3.1.1.11, EC 3.2.1.15, EC 3.2.1.67, and EC 3.2.1.82. Also considered pectinases in the context of the present invention are enzymes having the designations pectate lyase, pectinesterase, pectin demethoxylase, pectin methoxylase, pectin methylesterase, pectase, pectin methylesterase, pectinoesterase, pectin pectylhydrolase, pectin depolymerase, endopolygalacturonase, pectolase, pectin hydrolase, pectin polygalacturonase, endopolygalacturonase, poly-α-1,4-galacturonide glycanohydrolase, endogalacturonase, endo-D-galacturonase, galacturan 1,4-α-galacturonidase, exopolygalacturonase, poly(galacturonate) hydrolase, exo-D-galacturonase, exo-D-galacturonanase, exopoly-D-galacturonase, exopoly-α-galacturonosidase, exopolygalacturonosidase, or exopolygalacturanosidase.

Examples of enzymes suitable in this context are obtainable, for example, under the names Gamanase®, Pektinex AR®, or Pectaway® from the Novozymes company, under the name Rohapec® B1L from the AB Enzymes company, and under the name Pyrolase® from Diversa Corp., San Diego, Calif., USA. The β-glucanase recovered from *Bacillus subtilis* is available under the name Cereflo® from the Novozymes company. Glycosidases or hemicellulases particularly preferred according to the present invention are mannanases, which are marketed e.g. under the trade names Mannaway® by Novozymes or Purabrite® by Danisco/Genencor.

Examples of lipases or cutinases are the lipases obtainable originally from *Humicola lanuginosa* (*Thermomyces lanuginosus*) or lipases further developed therefrom, in particular those having the D96L amino acid exchange. They are marketed, for example, by the Novozymes company under the trade names Lipolase®, Lipolase® Ultra, LipoPrime®, Lipozyme®, and Lipex®. A further advantageously usable lipase is obtainable from the Novozymes company under the commercial name Lipoclean®. The cutinases that were originally isolated from *Fusarium solani pisi* and *Humicola insolens* are moreover usable, for example. Similarly usable lipases are obtainable from the Amano company under the designations Lipase CE®, Lipase P®, Lipase B® or Lipase CBS®, Lipase AKG®, *Bacillis* sp. Lipase®, Lipase AP®, Lipase M-AP®, and Lipase AML®. The lipases or cutinases from, for example, the Danisco/Genencor company, whose starting enzymes were originally isolated from *Pseudomonas mendocina* and *Fusarium solanii*, are usable. To be mentioned as further important commercial products are the preparations M1 Lipase® and Lipomax® originally marketed by the Gist-Brocades company (now Danisco/Genencor), and the enzymes marketed by Meito Sangyo KK, Japan, under the names Lipase MY-30®, Lipase OF®, and Lipase PL®, as well as the Lumafast® product of the Danisco/Genencor company.

In further embodiments, the enzyme is an oxidoreductase. "Oxidoreductases" are understood as enzymes of the first main class of the EC classification of enzymes (EC 1.X.X.X). They catalyze redox reactions. These include monooxygenases, dioxygenases, oxidases, dehydrogenases, reductases, and peroxygenases, among them in particular peroxidases (EC 1.11.X.X), for example halo-, chloro-, bromoperoxidases, lignin, glucose, or manganese peroxidases, catalases (EC 1.11.X.X), or laccases (EC 1.10.X.X). Oxidases, as likewise preferred oxidoreductases, transfer the electrons released upon oxidation of a substrate to oxygen ($O_2$). The oxygen serves in this context as an electron acceptor, and becomes reduced to water ($H_2O$) or to hydrogen peroxide ($H_2O_2$). Included among the oxidases are, for example, phenoloxidases, polyphenoloxidases, glucose oxidases, alcohol oxidases, or choline oxidases. Examples of oxidoreductases are the enzymes obtainable under the commercial names Denilite® of the Novozymes company.

In a further embodiment, the enzyme is a perhydrolase. A perhydrolase is an enzyme that is capable of catalyzing a reaction that results in the formation of peracid. Formation of a quantity of peracid or peracids sufficient for cleaning, bleaching, or disinfecting applications preferably occurs. A perhydrolase to be used according to the present invention is in particular any enzyme that is capable of catalyzing a perhydrolytic reaction in which at least one percarboxylic acid is released, as a bleaching agent, from at least one carboxylic acid ester with the aid of hydrogen peroxide, according to the following pattern:

$$R1\text{-}COOCH_3\text{—}R2+H_2O_2\text{—>}R1\text{-}COOOH+CH_3\text{—}R2\text{-}OH,$$

where R1 and R2 can each be any residues, which can be identical or different, for example $$CH_3CH_2CH_2COOCH_3+H_2O_2\text{—>}CH_3CH_2CH_2COOOH+CH_3OH.$$

Perhydrolases usable according to the present invention can belong to different enzyme classes; for example, they can be proteolytic enzymes that exhibit the perhydrolysis reaction as a secondary activity, or esterases, etc. All that is relevant for use as a perhydrolase according to the present invention is the enzyme's ability to be able to catalyze formation of a peracid, and in particular to be able to catalyze one of the reactions recited above. Preferred perhydrolases are furthermore those that exhibit a high ratio of perhydrolysis to hydrolysis. Such a ratio is advantageous because many enzymes usable as perhydrolases according to the present invention also catalyze hydrolytic reactions. Particularly preferably, the ratio of perhydrolysis to hydrolysis is greater than 1, and increasingly preferably greater than 1.1, 1.2, 1.3, 1.4, 1.5, 2.0, 2.5, 3.0, 4.0, 5.0, 6.0, 7.0, 8.0, 9.0, and 10.0. Examples of perhydrolases are disclosed in the international patent applications WO 2004/058961, WO 2005/056782, or WO 2007/070609, the respective disclosure of which is therefore expressly incorporated into the present application.

The enzymes used according to the present invention originally derive, for example, from microorganisms, e.g. the genera *Bacillus, Streptomyces, Humicola*, or *Pseudomonas*, and/or are produced by suitable microorganisms according to biotechnological methods known per se, e.g. by means of transgenic expression hosts, for example the genera *Escherichia, Bacillus*, or by filamentous fungi. It is emphasized that this can also involve, in particular, technical enzyme preparations of the respective enzyme, i.e. accompanying constituents can be present. The enzymes can therefore be packaged and used together with accompanying constituents, for example from fermentation, or with stabilizers.

Measuring the Specific Heat Capacity $c_p$

Determination of the specific heat capacity $c_p$ of solid and liquid substances was carried out by dynamic differential scanning calorimetry (DSC). The method used will be described in further detail below:

The determination is made up of the following individual steps:

- measuring the DSC baseline (empty sample pan) in the temperature range of interest
- measuring the DSC curve of the sample (in the same pair of pans)
- calculating the specific heat capacity at the desired temperature(s).

The specific heat capacity can be determined in a temperature range from approximately −10 to 600° C. using a thermal analyzer with a DSC cell (e.g. Perkin Elmer DSC 7). Because vaporizing sample constituents would distort the measurement results, encapsulated measurement pans that reduce this interference are used (aluminum pans of the TA Instruments company, which are pressure-tight to approx. 2 to 3 bar, have proven successful here). Pan bursting, or the occurrence of pan leaks, is apparent from the DSC diagram.

The specific heat capacity $c_p$ ($J*g^{-1}*K^{-1}$) of a substance is a characteristic thermodynamic magnitude. It is temperature-dependent, and indicates how much energy must be expended in order to heat one gram of a substance by one Kelvin at constant pressure:

$$c_p = \frac{\Delta Q}{m*(T_2 - T_1)}$$

$c_p$=specific heat capacity ($J*g^{-1}*K^{-1}$) at constant pressure p
ΔQ=quantity of heat required (J)
m=mass (g)
$T_2$-$T_1$=temperature elevation from $T_1$ to $T_2$ (K)

The equipment/accessories used for the analytical method described are listed below:

| Equipment/accessory | Manufacturer |
|---|---|
| Analytical balance, d = 0.01 mg, e.g. 235P-OCE | Sartorius |
| Thermal analyzer with DSC cell; e.g. DSC 7 | Perkin Elmer |
| Aluminum pan, encapsulated | |

In DSC measurement, a sample (portion weight approx. 5 to 15 mg) is heated usually at a constant rate. The excursion between the DSC measured signal of the sample and the baseline (DSC measurement of pan without sample) is proportional to the specific heat capacity of the sample.

It is recommended that the encapsulatable pans be first cleaned with, for example, acetone in an ultrasonic bath. This removes any adhering oil residues and improves cold welding upon encapsulation. The stability of the baseline (which is influenced by many factors) is also essential. The baseline must be recorded under completely identical measurement conditions. Measurement conditions for the Perkin Elmer DSC 7 are listed below:

| | |
|---|---|
| Sample portion weight | typically 5 to 15 mg |
| Sample pan | encapsulated pan, typically aluminum |
| Control pan | same type, empty sample pan |
| Sample preparation | none (optionally homogenization) |
| Heating rate | typically 10 K/min |
| Atmosphere | typically nitrogen |

-continued

| | |
|---|---|
| Temperature range | variable; approx. −10 to 600° C. |
| Pressure range | standard pressure |

Figure 30:
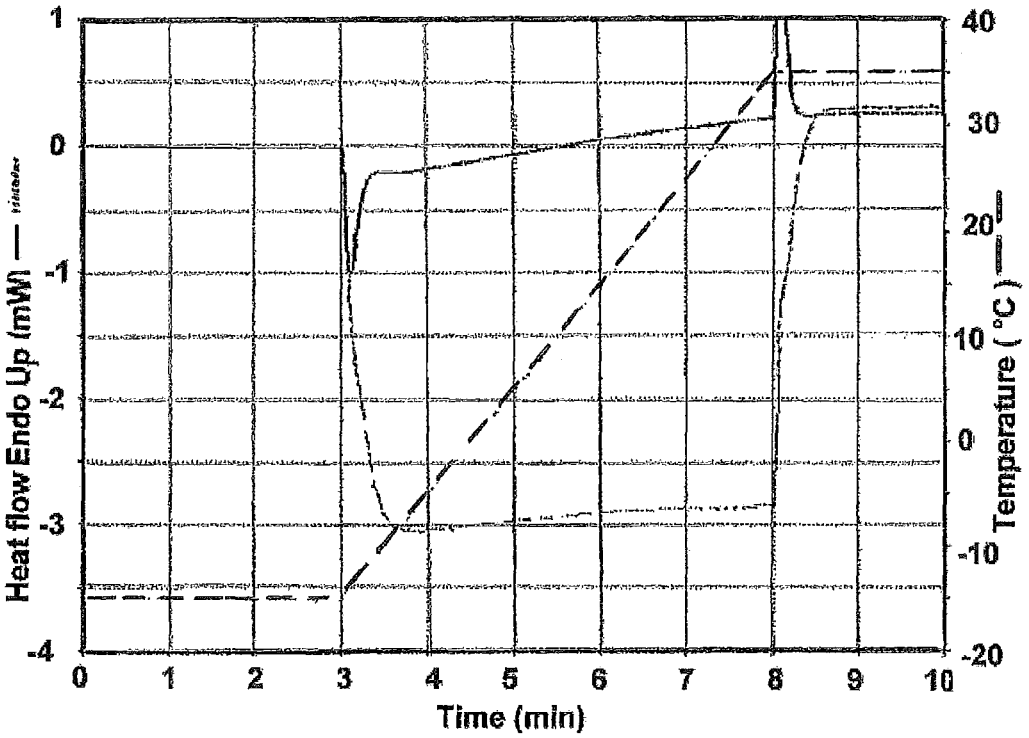
FIG. 30 Two-curve cp method (required individual measurements of zero line and sample)
Figure 31:
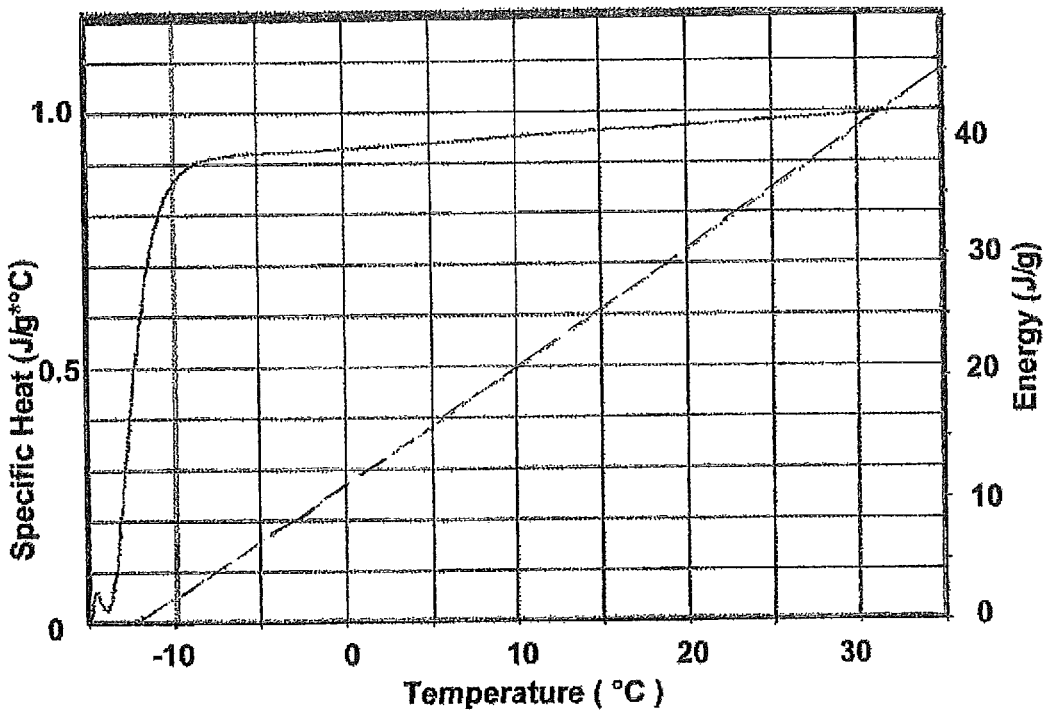
FIG. 31 Two-curve cp method (evaluation of a sample).

FIGS. 30 and 31 depict the $c_p$ measurement of a sample using the two-curve $c_p$ method, i.e. the standard measurement method. FIG. 30 shows the primary DSC measurements of the baseline (two empty, unencapsulated pans) and the sample measurement (encapsulated sample pan and empty pan). FIG. 31 shows the curve calculated therefrom for specific heat capacity $c_p$ ($J*g^{-1}*K^{-1}$) and the summed difference in enthalpy (J/g) in the temperature range from −15 to 35° C. The corresponding values may be gathered from the representative diagram.

With regard to the measurement methodology described, reference is also made to DIN 51007 E 6.94, Differential thermal analysis (DTA); ASTM E 1269-05, Determining specific heat capacity by differential scanning calorimetry; Perkin Elmer, user manual 0993-8686: Specific heat software kit; Chemiker-Kalender, 3rd ed. 1984; and D'Ans-Lax, Taschenbuch für Chemiker and Physiker [Handbook for chemists and physicists], 4th ed. 1992.

Measuring Enzyme Activity

To determine the enzyme activity, a three-chamber cartridge of the following specification was placed for 25 washing cycles into a model G1220 dishwasher of the Miele company, using a 70° C. program. The external cartridge shape corresponded to the configuration shown in FIG. 22. The division of the chambers corresponded to that in FIG. 20.

| | |
|---|---|
| Depth (T) | 22 mm |
| Width (B) | 230 mm |
| Height (H) | 185 mm |
| Wall thickness | 1.0 to 2.0 mm |
| Cp of wall | 1.68 J/(g*K) |
| Volume of chamber 1 (large outer chamber) | 400 ml |
| Volume of chamber 2 (middle chamber) | 80 ml |
| Volume of chamber 3 (small outer chamber) | 80 ml |
| Cp of preparation in chamber 1 | 2.81 J/(g*K) |
| Cp of preparation in chamber 2 | 3.57 J/(g*K) |
| Cp of preparation in chamber 3 (enzyme chamber) | 2.61 J/(g*K) |

The composition used for the enzyme chamber of the cartridge was as follows:

| Composition | wt % |
|---|---|
| 1,2-propylene glycol | 32.73 |
| Nonionic surfactant | 11.41 |
| Sodium cumolsulfonate (40%) | 20.00 |
| Protease | 28.51 |
| Amylase | 7.13 |
| Dye | 0.22 |
| Total | 100.00 |

After 25 washing cycles in the 70° washing program of the Miele G1220, the activity of the enzyme phase in a Miele model G1220 dishwasher was determined in a 50° C. normal washing program.

The skilled artisan knows of a number of different methods for determining the activity of enzyme proteins. Methods for determining the activity of enzyme proteins are usually relative methods, in which the enzyme protein activity is determined in relation to a reference sample. What is relevant is not the method itself, but the fact that the same method is used to determine the reference value and the actual sample.

The activity of the amylases, for example, was determined as follows: Amylases convert starch to glucose. Samples for investigation were incubated under defined reaction conditions (0.5% starch, soluble, pretreated per Zulkowsky, 50 mM sodium acetate pH 5, 40° C., 15 min). Glucose and other reducing sugars react with 0.75% p-hydroxybenzoic acid hydrazide with 0.75 mM bismuth (final concentration in each case) to yield a yellow dye, and can thus be determined photometrically at 410 nm after completion of the reaction and 10 minutes of incubation with the dye at 70° C. under alkaline conditions (addition of 0.375 M NaOH (final concentration); (the last two items are carried out so that a 1% solution of p-hydroxybenzoic acid with 1 mM bismuth in 0.5 M NaOH is prepared, and this is added to the incubated enzyme substrate solution at a ratio of ¾ to ¼). The quantity of sugar released is an indication of the enzyme activity. The indication, in CAU/g, is given by referring to a corresponding calibration series of a reference enzyme.

Methods for determining protease activity are disclosed, for example, in Tenside, Vol. 7 (1970), pp. 125-132. The proteolytic activity can furthermore be determined by way of the release of para-nitroaniline (pNA) chromophore from the sue-L-Ala-L-Ala-L-Pro-L-Phe-p-nitroanilide substrate (suc-AAPF-pNA). The protease cleaves the substrate and releases pNA. The release of pNA causes an increase in extinction at 410 nm, the change in which over time is an indication of enzymatic activity (see Del Mar et al., 1979). Measurement is performed at a temperature of 25° C., at pH 8.6 and a wavelength of 410 nm. The measurement time is 5 min, at a measurement interval from 20 s to 60 s. The protease activity is preferably indicated in CPU (protease units).

The table below presents the measured values for enzyme activity, for proteases and amylases, at the beginning of the measurement (reference value) and after 25 cycles in the 70° program of the aforementioned Miele automatic dishwasher:

| Sample | Protease (CPU/g) | Amylase (CAU/g) |
|---|---|---|
| Initial | 99,900 | 890 |
| After 25 cycles at 70° C. | 90,600 | 832 |

It is evident that the enzyme activities display only a slight loss, and sufficient enzyme stability still exists even after 25 washing cycles.

Description Of Illustrations

FIG. 1 shows, in the separated and the assembled state, an autonomous dispenser 2 having a two-chamber cartridge 1.

Dispenser 2 comprises two dispensing chamber inlets 21*a*, 21*b* for repeatedly detachable reception of the corresponding outlet openings 5*a*, 5*b* of chambers 3*a*, 3*b* of cartridge 1. Located on the front side are indicating and control elements 37 that indicate the operating state of dispenser 2 or act on it.

Dispensing chamber inlets 21*a*, 21*b* further comprise means that, upon placement of cartridge 1 onto dispenser 2, cause outlet openings 5*a*, 5*b* of chambers 3*a*, 3*b* to open, so that when dispenser 2 and cartridge 1 are in the coupled state, the interior of chambers 3*a*, 3*b* is communicatively connected to dispensing chamber inlets 21*a*, 21*b*.

Cartridge 1 can be made up of one or more chambers 3*a*, 3*b*. Cartridge 1 can be embodied in one piece with multiple chambers 3*a*, 3*b*, or in multiple pieces, the individual chambers 3*a*, 3*b* then being joined together into a cartridge 1 in particular by means of materially attached, positive, or frictionally engaged connecting methods.

Fastening can be accomplished, in particular, by means of one or more connection types from the group of the snap-in connections, press connections, melt connections, adhesively bonded connections, weld connections, solder connections, screw connections, keyed connections, clamp connections, or flip-closure connections. Fastening can, in particular, be embodied by a heat-shrink sleeve, which in a heated state is pulled over at least portions of the cartridge, and in the cooled state fixedly surrounds the cartridge.

In order to provide advantageous residual emptying properties for cartridge 1, the bottom of cartridge 1 can be inclined in the manner of a funnel toward delivery opening 5*a*, 5*b*. Moreover, the inner wall of cartridge 1 can be embodied, by suitable material selection and/or surface configuration, in such a way that little adhesion of material onto the internal cartridge wall occurs. This feature, too, allows the residual emptying capability of cartridge 1 to be further optimized.

Chambers 3*a*, 3*b* of cartridge 1 can have internal volumes that are identical or differ from one another. In the case of a configuration having two chambers 3*a*, 3*b*, the ratio of the chamber volumes is preferably 5:1, in the case of a configuration having three chambers preferably 4:1:1, these configurations being suitable in particular for use in automatic dishwashers.

One connection method can also consist in plugging chambers 3*a*, 3*b* into one of the corresponding dispensing chamber inlets 21*a*, 21*b* of dispenser 2, and thereby fastening them with respect to one another.

The connection between chambers 3*a*, 3*b* can in particular be embodied detachably, in order to permit separate replacement of a chamber.

Chambers 3*a*, 3*b* each contain a preparation 40*a*, 40*b*. Preparations 40*a*, 40*b* can have identical or different compositions.

Advantageously, chambers 3*a*, 3*b* are produced from a transparent material so that the fill level of preparations 40*a*, 40*b* is visible to the user from outside. It may also be advantageous, however, to produce at least one of the chambers from an opaque material, especially if the preparation present in that chamber contains light-sensitive ingredients.

Outlet openings 5*a*, 5*b* are configured so that they embody, with the corresponding dispensing chamber inlets 21*a*, 21*b*, a positive and/or frictionally engaged, in particular liquid-tight, connection.

It is particularly advantageous that each of the outlet openings 5*a*, 5*b* is embodied so that it fits onto only one of the dispensing chamber inlets 21*a*, 21*b*, thereby preventing a chamber from being inadvertently put onto an incorrect dispensing chamber inlet. This can be implemented, for example, by way of outlet openings 5*a*, 5*b* and/or dispensing chamber inlets 21*a*, 21*b* that are of different sizes or differ in terms of basic shape.

Cartridge 1 usually has an internal volume of <5000 ml, in particular <1000 ml, preferably <500 ml, particularly preferably <250 ml, very particularly preferably <50 ml.

In the assembled state, dispensing unit 2 and cartridge 1 can be adapted in particular to the geometries of the appliances on or in which they are utilized, so as to ensure the least possible loss of useful volume. To use dispensing unit 2 and cartridge 1 in automatic dishwashers, it is particularly advantageous to shape dispensing unit 2 and cartridge 1 by analogy with tableware to be cleaned in automatic dishwashers. Dispensing unit 2 and cartridge 1 can thus, for example, be plate-shaped, having approximately the dimensions of a dinner plate. As a result, the dispensing unit can be positioned in space-saving fashion in the lower rack.

Outlet openings 5*a*, 5*b* of cartridge 1 are preferably arranged on one line or in alignment, thus enabling a slender, plate-shaped embodiment of the dispensing metering unit.

Figure 2:
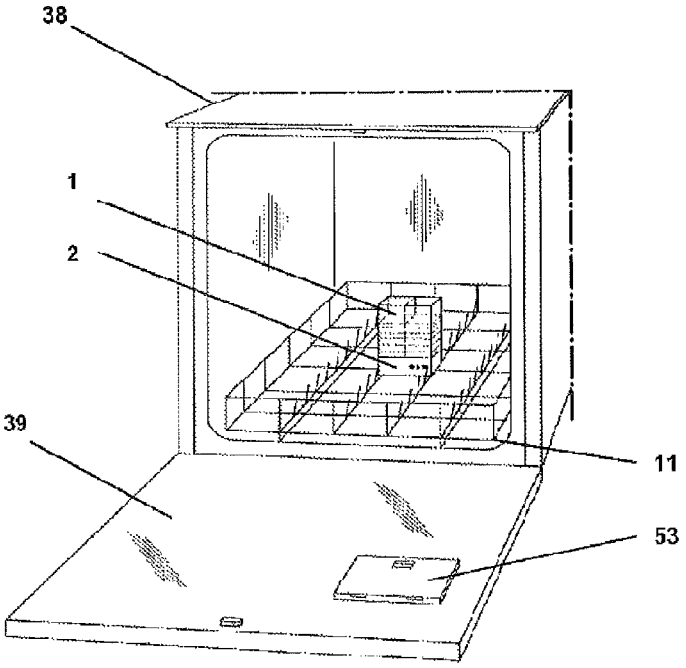
FIG. 2 Autonomous dispenser having a two-chamber cartridge, arranged in a rack of an automatic dishwasher.

FIG. 2 shows an autonomous dispenser having a two-chamber cartridge 1 in tableware rack 11, the automatic dishwasher door 39 of an automatic dishwasher 38 being open. It is evident that dispenser 2 having cartridge 1 is positionable in principle at any point within tableware rack 11, it being advantageous to provide a plate- or cup-shaped dispensing system 1, 2 in a corresponding plate or cup receptacle of tableware rack 11. Located in automatic dishwasher door 39 is a dispensing chamber 53 into which an automatic dishwasher cleaner preparation can be introduced, for example in the form of a tablet. When dispensing system 1, 2 is in the operational state in the interior of dishwasher 38, it is therefore unnecessary to add cleaning preparation for each washing cycle via dispensing chamber 53, since cleaning agent delivery is implemented via dispensing system 1, 2 for a plurality of washing cycles. An advantage of this embodiment of the invention is that when the autonomous dispensing system 1, 2 is arranged in the lower dishwasher rack 11, preparations 40*a*, 40*b* are delivered out of cartridge 1 into the washing bath directly via the outlet openings arranged at the bottom of the dispenser, so that quick dissolution and uniform distribution of the washing preparations in the washing program is ensured.

Figure 3:
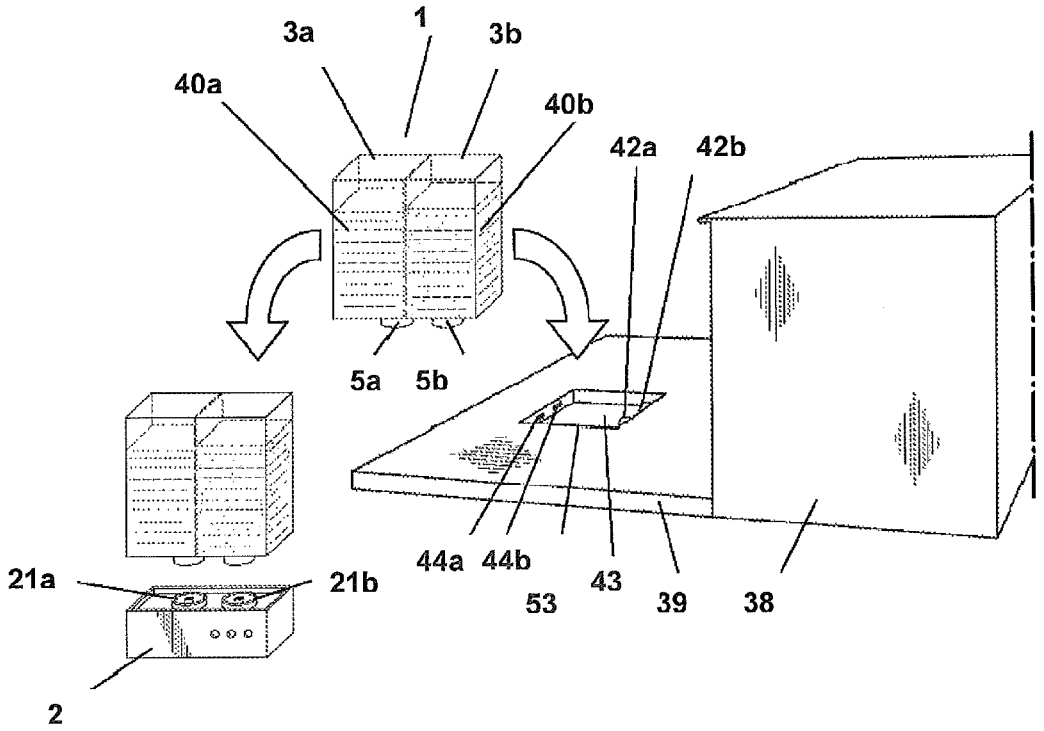
FIG. 3 Two-chamber cartridge separated into an autonomous and an internal machine-integrated dispenser.

FIG. 3 shows a two-chamber cartridge 1 separated into an autonomous dispenser 2 and an internal, machine-integrated dispenser. Cartridge 1 is embodied in this context in such a way that it is couplable both to autonomous dispenser 2 and to the machine-integrated dispenser (not depicted; can be located, for example, in automatic dishwasher door 39); this is indicated by the arrows depicted in FIG. 3.

Shaped onto that side of automatic dishwasher door 39 which is directed toward the interior of automatic dishwasher 38 is a depression 43 into which cartridge 1 can be inserted, outlet openings 5*a*, 5*b* of cartridge 1 being, as a result of the insertion, communicatively connected to adapter pieces 42*a*, 42*b*. Adapter pieces 42*a*, 42*b* are in turn coupled to the machine-integrated dispenser.

In order to fasten cartridge 1 in depression 43, holding elements 44*a*, 44*b* that ensure frictionally engaged and/or positive fastening of the cartridge in depression 43 are provided on depression 43. It is of course also conceivable for corresponding holding elements to be provided on cartridge 1. Holding elements 44*a*, 44*b* can preferably be selected from the group of the snap connections, latch connections, snap/latch connections, clamp connections, or plug connections.

During the operation of automatic dishwasher 38, preparation 40*a*, 40*b* is conveyed by the machine-integrated dispenser out of cartridge 1 and through adapter elements 42*a*, 42*b* to the corresponding washing cycle.

Figure 4:
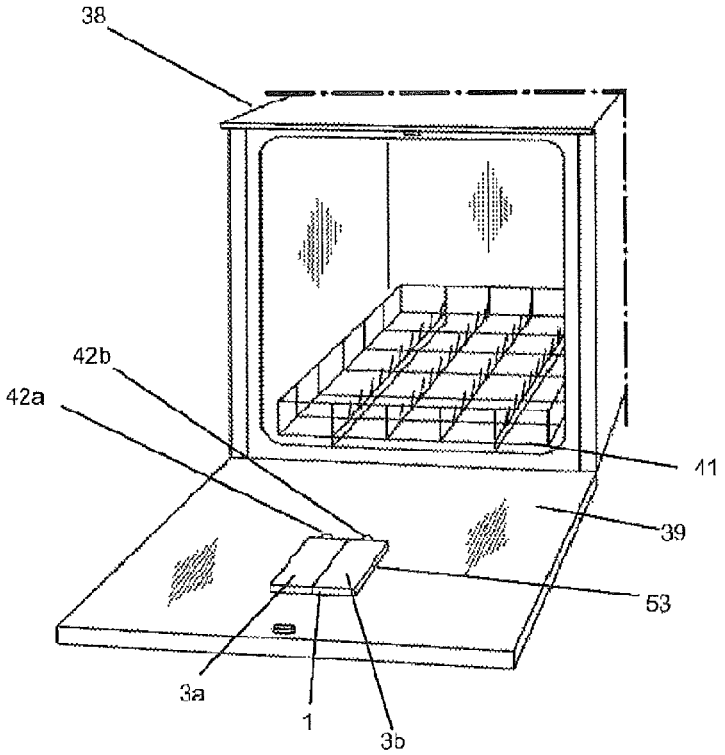
FIG. 4 Two-chamber cartridge assembled with an internal machine-integrated dispenser.

FIG. 4 shows cartridge 1, known from FIG. 3, as installed in door 39 of an automatic dishwasher 38. It is evident that thanks to the integration of dispensing unit 2 and cartridge 1 into door 39 of the automatic dishwasher, no space in tableware rack 11 for washed items is lost; this represents a substantial advantage of this embodiment.

Figure 5:
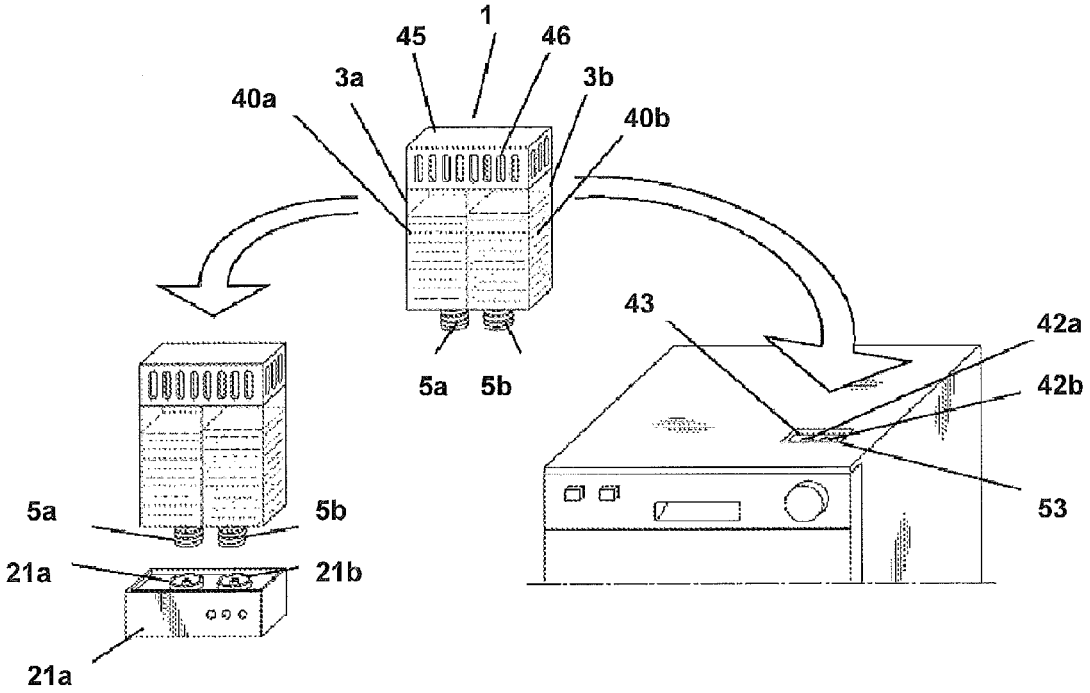
FIG. 5 Two-chamber cartridge separated into an autonomous and an external machine-integrated dispenser.

A further embodiment of the invention is illustrated in FIG. 5. FIG. 5 shows cartridge 1, known from FIG. 3, having a chamber 45 that is arranged at the top of cartridge 1 and comprises in its enveloping surface a plurality of openings 46. Chamber 45 is preferably filled with an air freshening preparation that is delivered through openings 46 to the environment. The air freshening preparation can encompass, in particular, at least one scent and/or one odor-counteracting substance.

In contrast to the arrangement as known from FIG. 3 and FIG. 4 of cartridge 1 in the interior of an automatic dishwasher 1, it is also possible to provide a depression 43, having adapter elements 42*a*, 42*b* for coupling to cartridge 1, on an outer surface of an automatic dishwasher 38. This is depicted by way of example in FIG. 5 and FIG. 6. This configuration can be advantageous in particular for highly temperature-sensitive preparations 40*a*, 40*b*, since they are not directly exposed to the temperature fluctuations usually occurring in the washing program.

Figure 6:
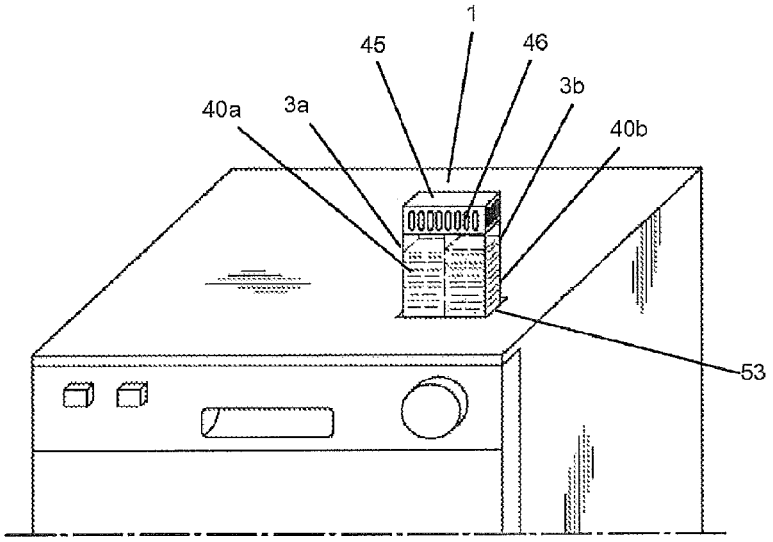
FIG. 6 Two-chamber cartridge assembled with an external machine-integrated dispenser.

Cartridge 1 illustrated in FIG. 5 and FIG. 6 can of course also be arranged, with a chamber 45 containing an air freshening substance, in a correspondingly embodied receptacle in the interior of an automatic dishwasher 38.

Figure 7:
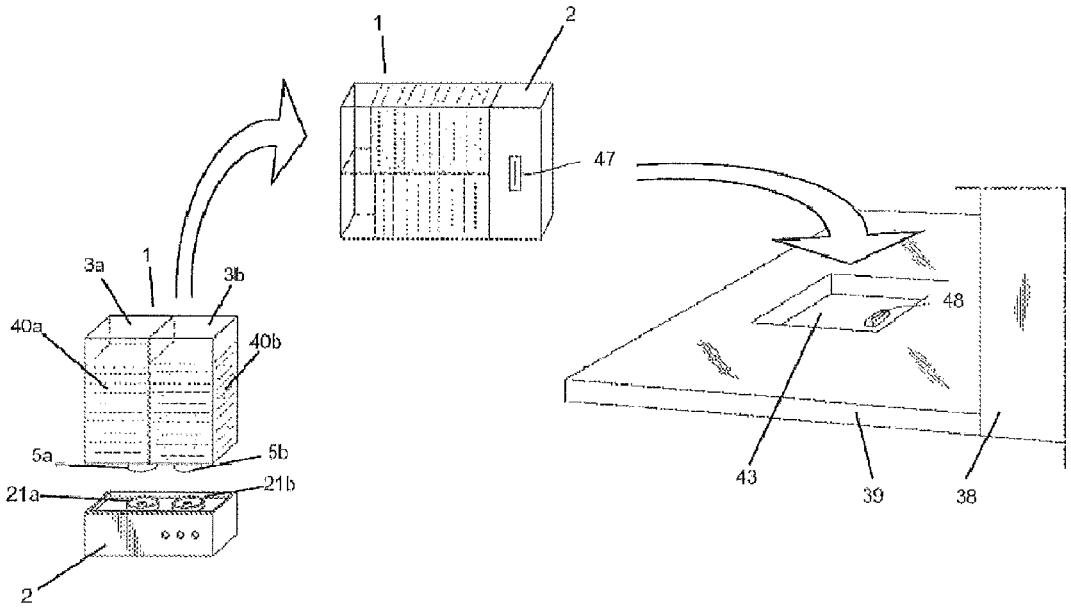
FIG. 7 Two-chamber cartridge in the separated state, and assembled to an autonomous, machine-integratable dispenser.
Figure 8:
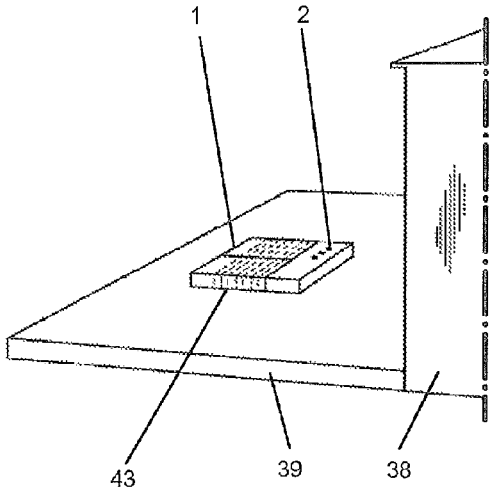
FIG. 8 Two-chamber cartridge assembled to an autonomous, machine-integrated dispenser.

A further embodiment of the invention is shown in FIG. 7 and FIG. 8. Here dispenser 2 can be coupled to cartridge 1, as correspondingly indicated by the first arrow on the left in the drawing. Cartridge 1 and dispenser 2 are then coupled as one subassembly, via interface 47, 48, to the dishwasher, as indicated by the arrow on the right. Dispenser 2 comprises an interface 47 through which data and/or energy are transferred to and/or from dispenser 2. A depression 43 for the reception of dispenser 2 is provided in door 39 of dishwasher 38. Provided in depression 43 is a second interface 48 that transfers data and/or energy to and/or from dispenser 2.

Data and/or energy are preferably exchanged wirelessly between first interface 47 on dispenser 2 and second interface 48 on dishwasher 38. It is particularly preferred that energy be transferred from interface 48 of dishwasher 38 wirelessly via interface 47 to dispenser 2. This can occur, for example, inductively and/or capacitively.

It is further advantageous also to configure the interface for the transfer of data wirelessly. This can be achieved using methods known in the existing art for the wireless transfer of data, for example by radio transfer or IR transfer. It is particularly preferred to embody the transfer of data and signals wirelessly by means of optical transfer technologies in the visible region.

Alternatively, interfaces 47, 48 can also be embodied by means of integrated plug connections. Advantageously, the plug connections are embodied in such a way that they are protected from the penetration of water or moisture.

FIG. 8 shows dispensing system 1, 2 in the state coupled with automatic dishwasher 38 in depression 43 of automatic dishwasher door 39.

Figure 9:
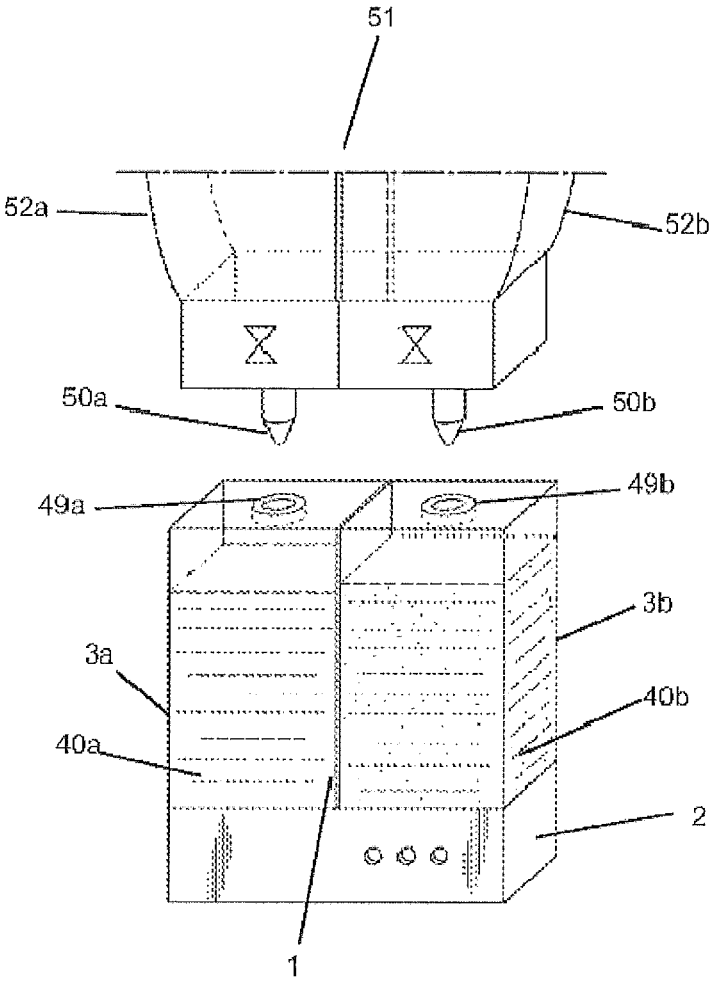
FIG. 9 Autonomous dispenser having a refillable two-chamber cartridge and refilling unit.

FIG. 9 shows a cartridge 1 whose chambers 3*a*, 3*b* are fillable via the top-side openings 49*a*, 49*b*, for example by means of a refill cartridge 51. Openings 49*a*, 49*b* of cartridge 1 can be embodied, for example, as silicone valves that open upon penetration by adapter 50*a*, 50*b* and close again upon removal of adapter 50*a*, 50*b*, thereby preventing unintentional outflow of preparation from the cartridge.

Adapters 50*a*, 50*b* are embodied in such a way that they can penetrate openings 49*a*, 49*b* of cartridge 1. Advantageously, openings 49*a*, 49*b* of cartridge 1, and adapter 50*a*, 50*b*, are configured in terms of their position and size in such a way that the adapter can engage into openings 49*a*, 49*b* only in one predefined position. This allows, in particular, incorrect filling of cartridge chambers 3*a*, 3*b* to be prevented, and ensures that the respectively identical or compatible preparation travels out of a chamber 52*a*, 52*b* of refill cartridge 51 into the corresponding chamber 3*a*, 3*b* of cartridge 1.

Further exemplifying embodiments of the cartridge known from the previous illustrations are shown in FIG. 10 to FIG. 16.

Figure 10:
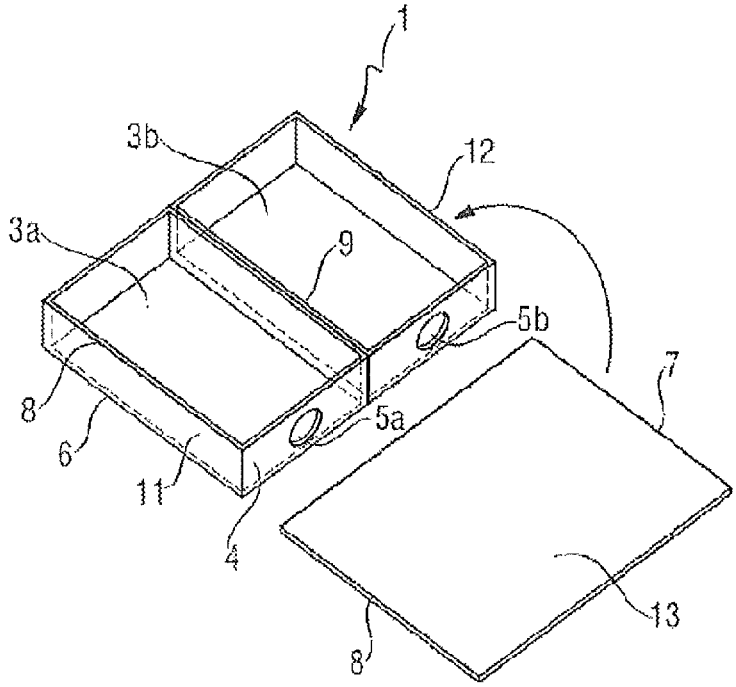
FIG. 10 Cartridge constituted from a trough-shaped and a cover-shaped cartridge element.

In a first embodiment that is reproduced in FIG. 10, cartridge 1 is made up of a first trough-shaped element 6 and a second plate- or cover-like element 7; FIG. 10 shows the two elements 6, 7 in the unassembled state. The second plate- or cover-like element 7 is dimensioned so that when cartridge 1 is in the assembled state, the element completely covers first trough-shaped element 6 along connecting edge 8.

First trough-shaped element 6 is formed by cartridge top 10, cartridge side surfaces 11 and 12, and cartridge bottom 4. The two chambers 3*a*, 3*b* of cartridge 1 are defined by separating web 9. A respective outlet opening 5*a*, 5*b* is provided on cartridge bottom 4 for each of the chambers 3*a*, 3*b*. Cartridge 1 is formed by materially attached joining of first trough-shaped element 6 to the second plate- or cover-like element 7, such that in the assembled state, connecting edge 8 does not intersect outlet openings 5*a*, 5*b* of cartridge 1.

Figure 11:
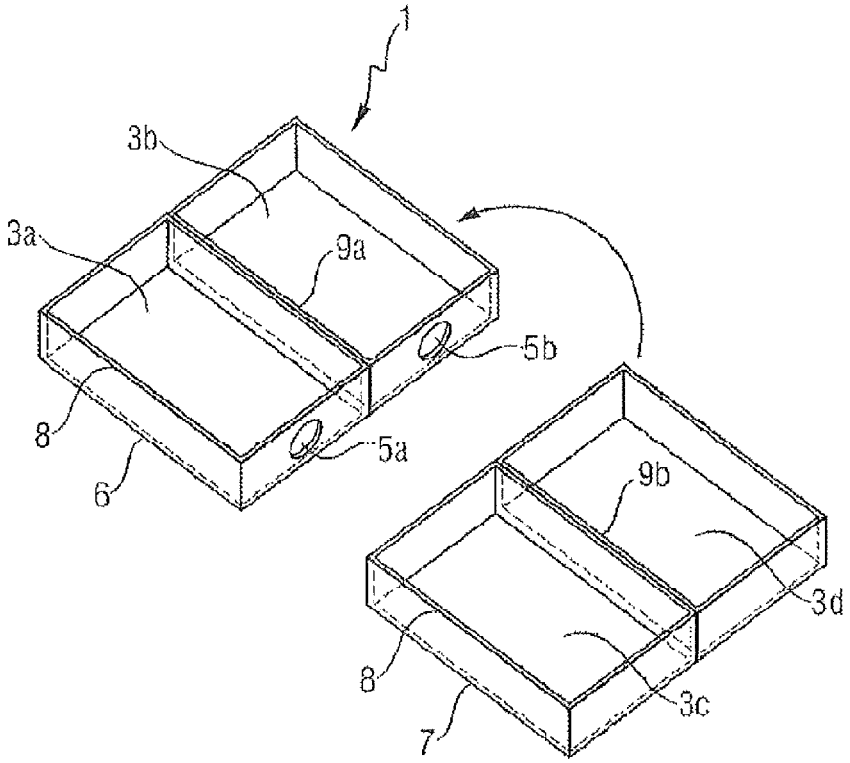
FIG. 11 Cartridge constituted from two trough-shaped cartridge elements.

A further possible configuration of the cartridge is shown by FIG. 11, in which two cartridge elements 6, 7 are once again visible in the not-yet-assembled state. The two cartridge elements 6, 7 are embodied mirror-symmetrically, so that in the assembled state the connecting edges 8 of the two elements 6, 7 rest completely against one another. Outlet openings 5*a* and 5*b* are embodied only on bottom 4 of first cartridge element 6, so that connecting edge 8 of elements 6, 7 on cartridge bottom 4 extends outside outlet openings 5*a*, 5*b*, and connecting edge 8 therefore does not intersect outlet openings 5*a*, 5*b*. More reliable sealing of outlet openings 5*a*, 5*b* can thereby be ensured, since material deformations in the region of outlet openings 5*a*, 5*b*, in particular because of thermal loads, are more uniform, and an abutting or connecting edge 8 does not result in an inhomogeneous deformation that can subsequently result in undesired sealing problems, especially upon insertion of the cartridge and/or during temperature alternations within a washing program.

Figure 12:
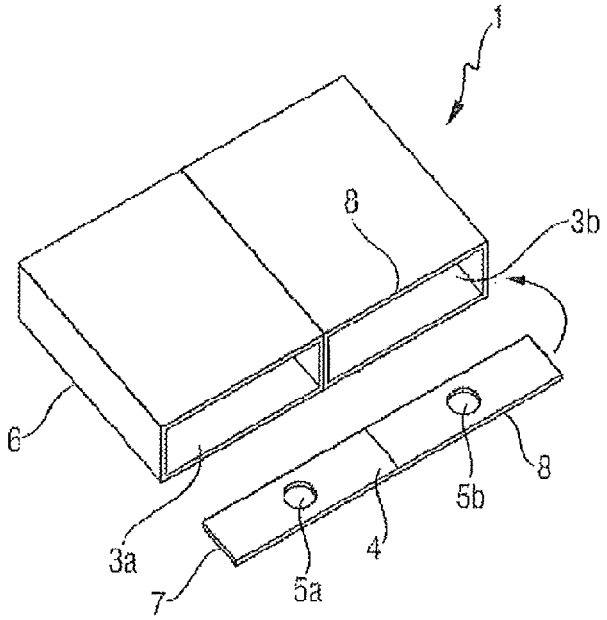
FIG. 12 Cartridge constituted from a cell-shaped bottomless container and a cartridge bottom.

FIG. 12 shows a variant of the cartridge known from FIG. 10 and FIG. 11. In this embodiment, first cartridge element 6 is configured as a one-piece cell-shaped bottomless plastic container. Cartridge 1 is formed by fitting bottom 4 onto container 6 along connecting edge 8, as indicated by the arrow in the Figure. Bottom 4 comprises a first opening 5*a* and a second opening 5*b* which, when cartridge 1 is in the assembled state, permit preparation to flow out of the respective chambers 3*a*, 3*b*. Here as well, in the assembled state the connecting edge 8 extends outside outlet openings 5*a*, 5*b*.

Figure 13:
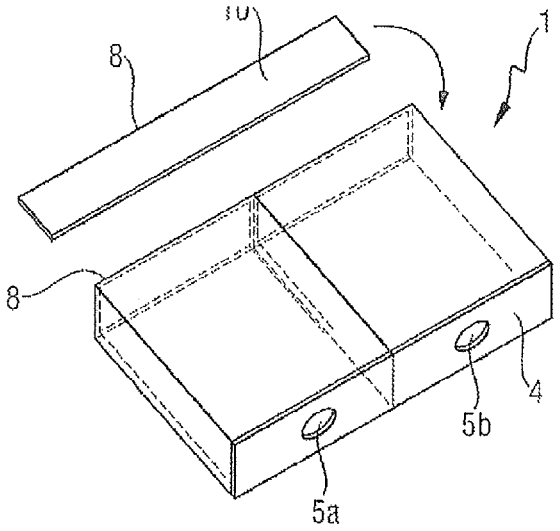
FIG. 13 Cartridge constituted from a cell-shaped container, open at the top, having a cartridge cover.

As an alternative thereto, it is also conceivable for a cartridge element 6 to be embodied as a cell-like container open at the top and having chambers 3*a*, 3*b*, and the second element as cartridge cover 10 that is connected in liquid-tight fashion along connecting edge 8 to the cell-like container open at the top; once again, when cartridge 1 is in the assembled state, connecting edge 8 extends outside outlet openings 5*a*, 5*b*, as is evident from FIG. 13.

Figure 14:
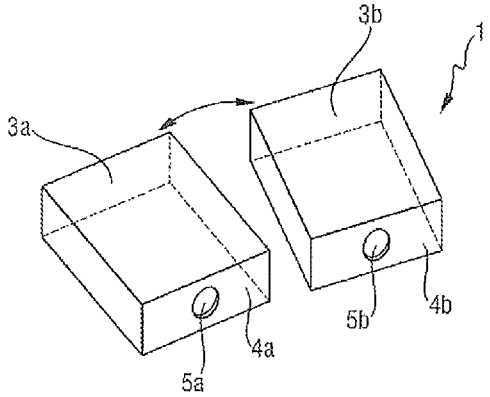
FIG. 14 Cartridge constituted from two chamber elements.

FIG. 14 illustrates the fact that cartridge 1 can also be formed from two chambers 3*a*, 3*b* shaped separately from one another. In this variant embodiment, the two chambers 3*a*, 3*b* are connected by material attachment, positively, and/or in frictionally engaged fashion to one another, detachably or nondetachably, and thus form cartridge 1.

Figure 15:
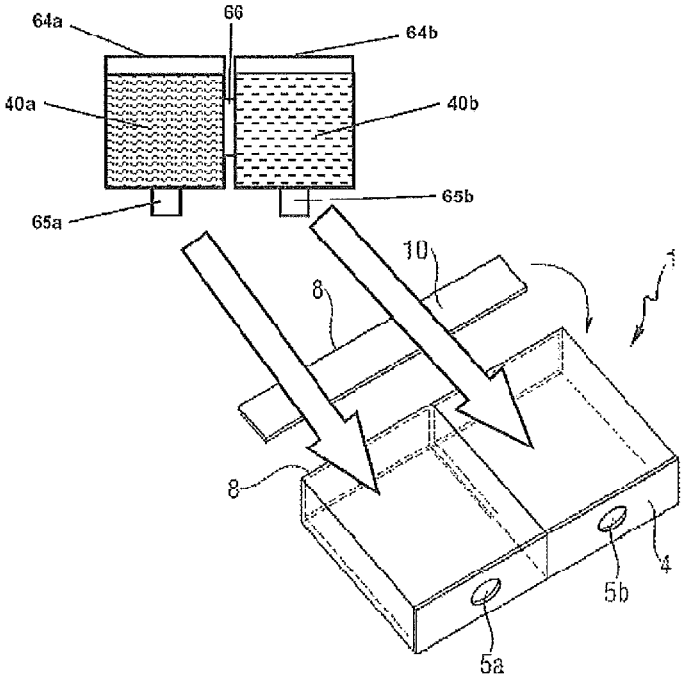
FIG. 15 Cartridge with refill pouch.

FIG. 15 shows cartridge 1, known from FIG. 13, as a receiving vessel for a pouch 64 filled with preparation 40, so that a so-called "bag-in-bottle" vessel is embodied by insertion of the pouch into the cartridge chambers, as indicated by the arrows in the illustration. Openings 65*a*, 65*b* of pouch 64*a*, 64*b* are shaped in such a way that they can be inserted into openings 5*a*, 5*b* of cartridge 1. Openings 65*a*, 65*b* are preferably shaped as dimensionally stable plastic cylinders. It is on the one hand conceivable for each pouch 64*a*, 64*b* to be positioned into a corresponding chamber of cartridge 1, but it is also possible to embody a multichamber pouch, connected via a web 66, that is inserted as a whole into the cartridge. After insertion of pouch 64 into cartridge 1, the latter is detachably closed off by cartridge top 10. In order to prevent undesired loss of cartridge top 10, it is especially advantageous to secure it pivotably on cartridge 1, for example by means of a material bridge.

Figure 16:
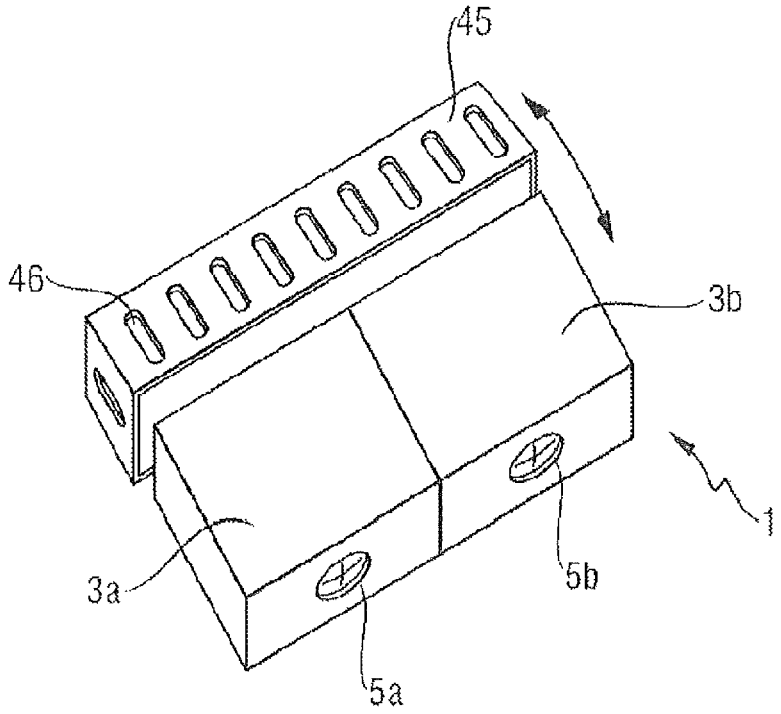
FIG. 16 Cartridge having a chamber for delivering volatile substances.

FIG. 16 shows a refinement of the cartridge known from FIG. 10 to FIG. 14, in which a further chamber 45 for receiving a preparation is arranged on the cartridge and is configured in such a way that a delivery of volatile substances from the preparation into the environment of chamber 45 is brought about. Chamber 45 can contain, for example, volatile scents or air freshening substances, which are delivered to the environment through openings 46 of chamber 45.

It is further evident that openings 5*a*, 5*b* are closed off by silicone valves that have an X-shaped slit. This prevents preparation 40 from emerging from the uncoupled cartridge 1 upon detachment of cartridge 1 from dispenser 2.

Figure 17:
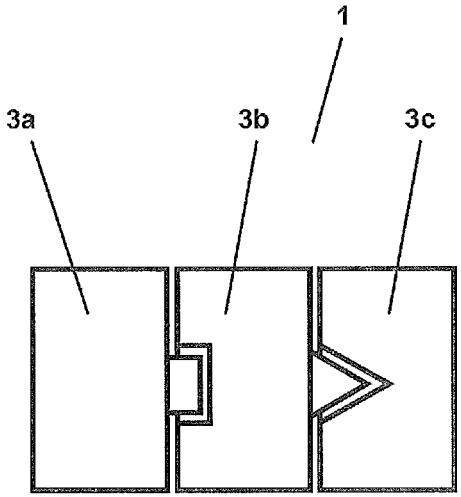
FIG. 17 Plan view of cartridge having three positively connected chambers.

FIG. 17 is a plan view of a cartridge 1 having individually replaceable chambers 3*a*, 3*b*, 3*c*. Chambers 3*a*, 3*b*, 3*c* are shaped, thanks to mutually corresponding contours of their lateral surfaces, in such a way that they can be combined into a cartridge 1 only in one specific, defined mutual arrangement. This makes it possible in particular to provide individually replaceable chambers without resulting in an undesired arrangement of the chambers, and their corresponding preparations, with respect to one another.

Figure 18:
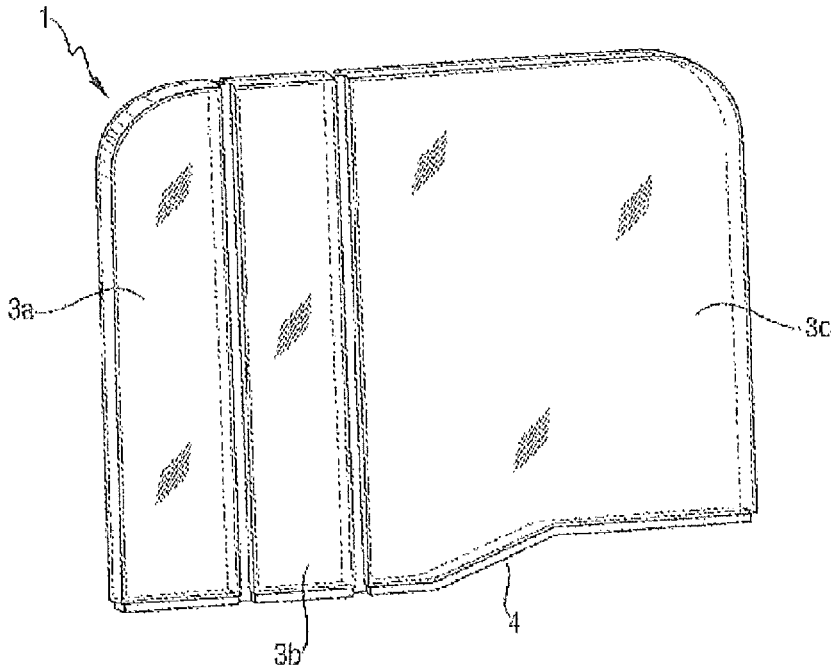
FIG. 18 Front view of cartridge having three chambers.

FIG. 18 shows a further possible embodiment of cartridge 1 having three chambers 3*a*, 3*b*, 3*c*. First chamber 3*a* and second chamber 3*b* have an approximately identical internal volume. Third chamber 3*c* has an internal volume that is approximately five times as great as that of one of chambers 3*a* or 3*b*. Cartridge bottom 4 comprises a ramp-like step in the region of third chamber 3*c*. Thanks to this asymmetrical conformation of cartridge 1, it is possible to ensure that cartridge 1 is couplable, in a position provided therefor, with dispenser 2, and to prevent insertion in an incorrect position by way of a corresponding configuration of dispenser 2 or of bracket 54.

Figure 19:
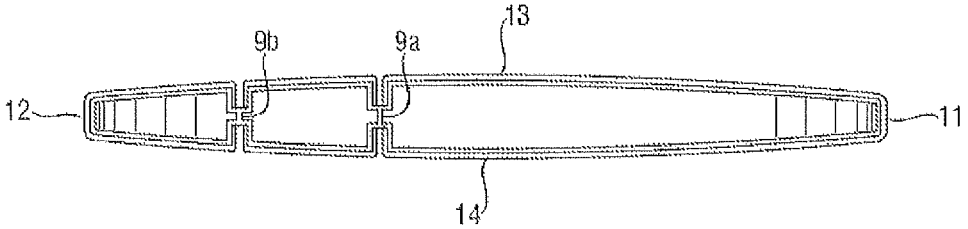
FIG. 19 Plan view of cartridge having three chambers.

The plan view of the cartridge illustrated in FIG. 19 shows separating webs 9*a* and 9*b* that separate the chambers of cartridge 1 from one another. The cartridge known from FIG. 18 and FIG. 19 can be formed in various ways.

Figure 20:
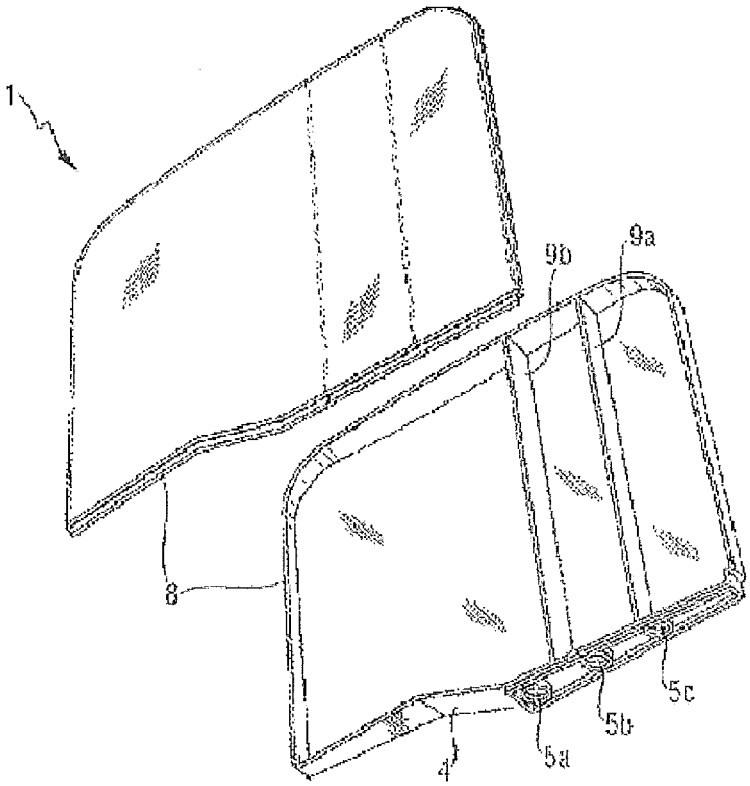
FIG. 20 Exploded depiction of two-part cartridge having a trough-shaped and a plate-like cartridge element.

In a first variant that may be gathered from FIG. 20, cartridge 1 is formed from a first trough-like cartridge element 7 and a second cover- or plate-like cartridge element 6. Shaped in trough-like cartridge element 7 are separating webs 9*a* and 9*b* by which the three chambers of cartridge 1 are embodied. Outlet openings 5*a*, 5*b*, 5*c* are arranged on bottom 4 of trough-shaped cartridge element 7, underneath the respective chambers of cartridge 1.

As may further be gathered from FIG. 20, bottom 4 of the cartridge comprises, in the region of third chamber 3*c*, a ramp-like step that embodies on the chamber bottom a downward slope in the direction of third outlet opening 5*c*. This ensures that preparation present in this chamber 3*c* is always directed toward outlet opening 5*c*, and that good residual emptying characteristics for chamber 3*c* are thus achieved.

When cartridge 1 is in the assembled state, trough-shaped cartridge element 7 and cover-like cartridge element 6 are connected by material attachment to one another along the shared connecting edge 8. This can be realized, for example, by welding or adhesive bonding. Webs 9*a*, 9*b* are of course also connected by material attachment to cartridge element 6 when cartridge 1 is in the assembled state.

Connecting edge 8 here does not extend through outlet openings 5*a-c*; this avoids sealing problems, in particular in the state coupled to the dispenser, in the region of openings 5*a* to 5*c*.

Figure 21:
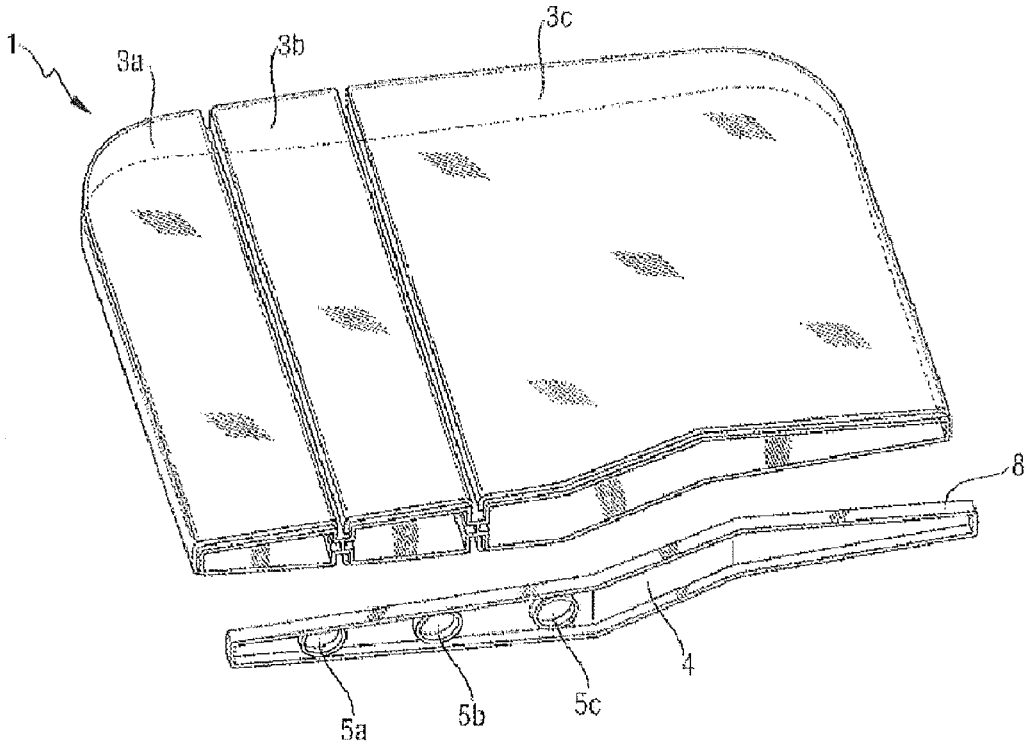
FIG. 21 Exploded depiction of two-part cartridge having a cell-like container and a cartridge bottom.

FIG. 21 shows a further variant for embodiment of the cartridge. Here first cartridge element 6 is embodied in cell-like fashion and comprises an open bottom. The separately shaped bottom 4 can be inserted, as a second cartridge element 7, into the bottom-side opening of cell-like cartridge element 6 and connected by material attachment along the shared connecting edge 8. The advantage of this variant is that cell-like element 6 can be economically manufactured using a plastic blow-molding method.

Figure 22:
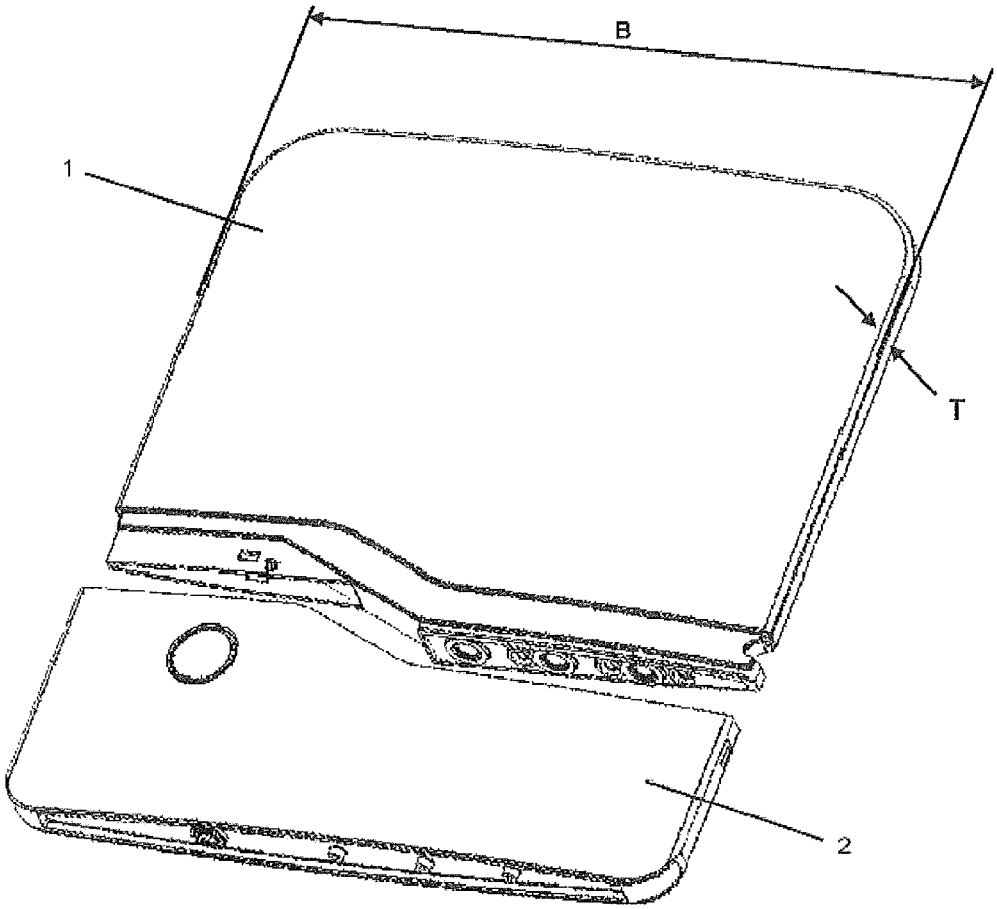
FIG. 22 Perspective view of three-chamber with dispenser, in the separated state.

FIG. 22 shows a further embodiment of cartridge 1 and of dispenser 2 in the state not coupled to one another. Cartridge 1 of FIG. 21 will be explained further with reference to FIG. 22.

FIG. 22 is a perspective view of cartridge 1 known from FIG. 21. Outlet openings 5 and vent openings 81 are arranged, alternatingly with one another, on cartridge bottom 4. One outlet opening 5 and one vent opening 81 is provided for each of the chambers in cartridge 1. The width (B) of cartridge 1 is substantially greater than the depth (T). The ratio of depth (T) to width (B) of cartridge is equal to approximately 1:20.

Figure 23:
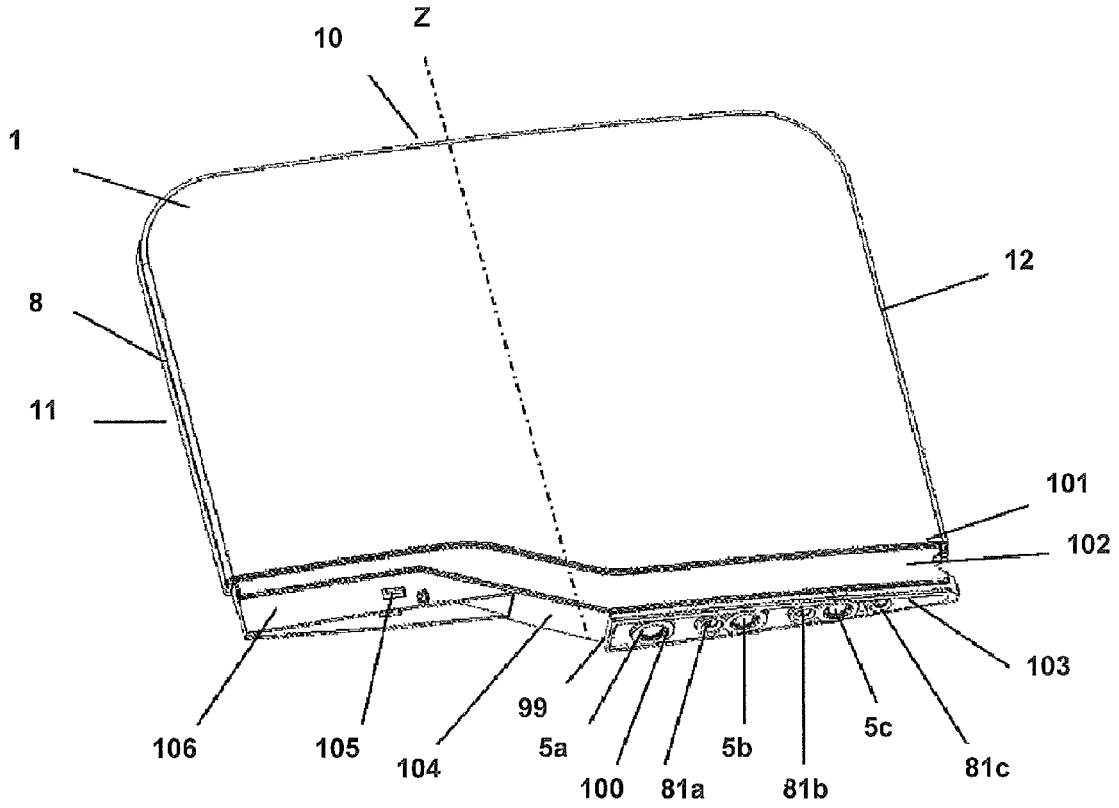
FIG. 23 Perspective view of three-chamber cartridge having vent openings.

The region of cartridge bottom 4 on which the outlet and vent openings are arranged is surrounded by a peripheral collar 99 (see also FIG. 23). This collar 99 on the one hand brings about structural reinforcement of cartridge 1 in the bottom region, which prevents deformation in bottom region 4 especially upon insertion of cartridge 1, when corresponding applied pressures act on bottom region 4 in order to couple cartridge 1 to dispenser 2, thereby enabling controlled and secure insertion of cartridge 1 into dispenser 2.

Collar 99 further offers protection from undesired mechanical effects on the closures of the outlet and vent openings. As is evident from FIG. 22, outlet and vent openings 5, 81 are set back with respect to collar 99, so that openings 5, 81 are, for example, protected from the direct action of objects that are larger than the openings.

As is further visible in FIG. 22, outlet and vent openings 5, 81 each comprise a collar 100. This collar 100 enclosing outlet and vent openings 5, 81 also serves for structural reinforcement of outlet and vent openings 5, 81 in bottom region 4 of cartridge 1. In addition, collar 100 can serve to strengthen closure means of outlet and vent openings 5, 81, for example closure plugs or closure covers.

Collar 100 of one of outlet and vent openings 5, 81 is set back with respect to collar 99, so that collar 100 does not project beyond the edge of collar 99.

It may further be gathered from FIG. 23 that cartridge 1 is embodied asymmetrically with regard to its axis Z-Z. The effect of this asymmetry is that cartridge 1 is couplable to dispenser 2, in particular to inlet openings 21 of dispenser 2, in only one defined way. The result is to embody a mechanical lock-and-key principle between cartridge 1 and dispenser 2, preventing incorrect operation upon coupling of cartridge 1 to dispenser 2.

The asymmetry of cartridge 1 is also brought about, inter alia, by the fact that bottom 4 comprises two planes, the first plane being formed by collar 99 that encloses outlet and vent openings 5, 81 and the second plane being a bottom segment that is offset via a ramp 104 toward cartridge top 10, as is clearly apparent e.g. in FIG. 22 and FIG. 23.

Proceeding from ramp 104, there extends from the bottom section of the second plane a further collar 105 that comprises an opening 106. Opening 106 forms, with a corresponding engagement of dispenser 2, a detachable latching connection to retain cartridge 1 in the coupled state with dispenser 2.

Also evident in FIG. 23 is a peripheral edge 101 in the lower, bottom-side region of cartridge 1. Extending from this edge 101 in the bottom direction is a peripheral wall segment 102 of cartridge 1 that is set back toward the interior of cartridge 1 so that a shoulder extending toward the interior of the cartridge is embodied between edge 101 and wall segment 102.

Dispenser 2 is embodied in such a way that peripheral wall segment 102 can be introduced into collar 103 of dispenser 2 (see also FIGS. 28 to 29); with cartridge 1 and dispenser 2 in the coupled position, edge 101 of the cartridge rests on collar 103 of the dispenser, so that the space surrounded by collar 103 of dispenser 2 is protected at least from the entry of sprayed water. Collar 103 of dispenser 2 and edge 101 of the cartridge can also, in particular, be configured so that with cartridge 1 and dispenser 2 in the coupled state, entry of water into the space of the dispenser surrounded by collar 103 is prevented by a substantially sealing abutment of edge 101 on collar 103.

In addition, the inwardly offset wall segment 102 of the cartridge, in conjunction with the dispenser-side collar 103, brings about guidance of cartridge 1 upon insertion into dispenser 2.

Figure 24:
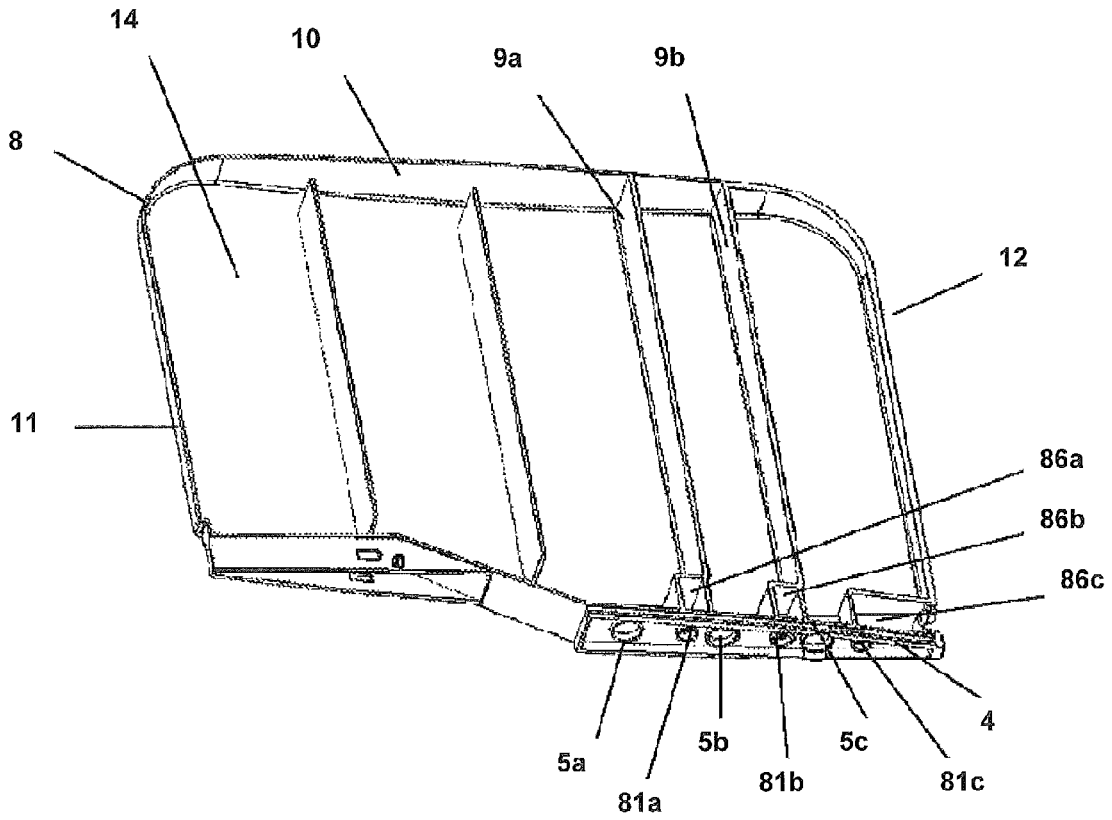
FIG. 24 Perspective inside view into a three-chamber cartridge with front wall removed.

Cartridge 1 is formed from two elements that are positively welded to one another at the peripheral connecting edge 8. FIG. 24 shows cartridge 1 known from FIG. 23 with a cover-like element removed along connecting edge 8, so that FIG. 24 provides a view into the interior of cartridge 1.

It is evident that cartridge 1 is subdivided by the two separating webs 9*a*, 9*b* into three chambers, each of the chambers having at the bottom, in the direction of gravity, an outlet opening 5.

Figure 25:
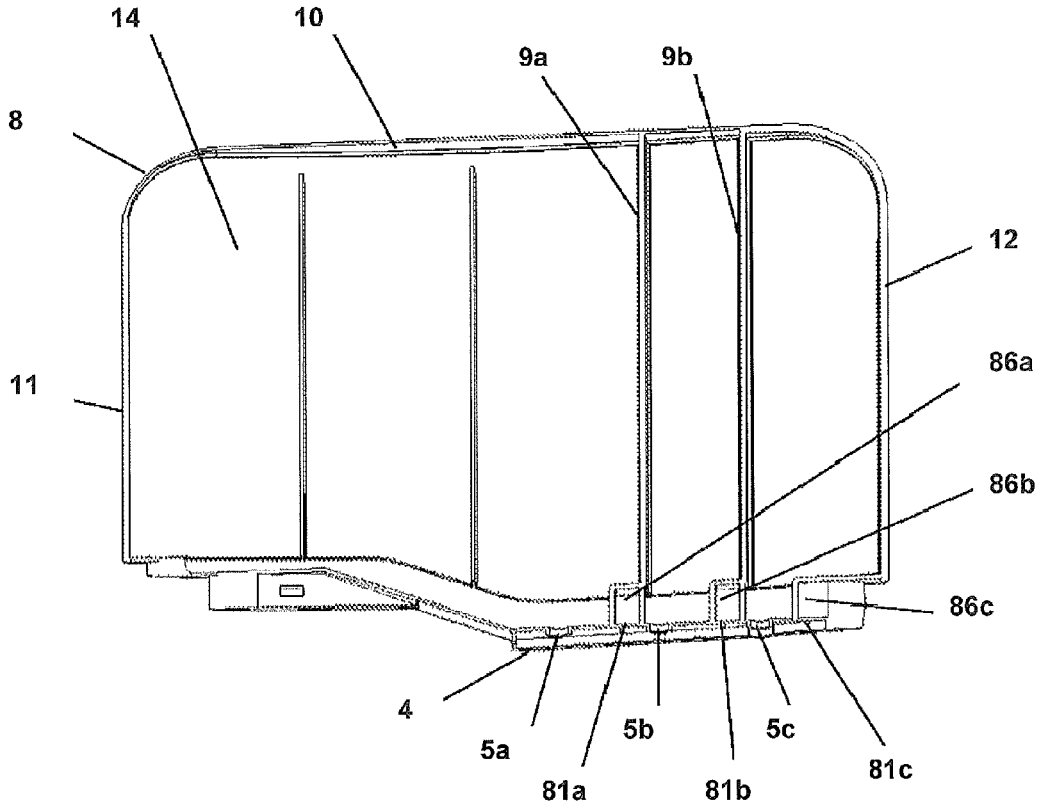
FIG. 25 Longitudinal sectioned view into a three-chamber cartridge.

Arranged at the bottom end of separating webs 9 are vent chambers 86 that enclose vent openings 81 on the inner side of the cartridge. Vent chambers 86 serve on the one hand for structural reinforcement of cartridge bottom 4 in the region of vent openings 81, so that deformation upon coupling of cartridge 1 to dispenser 2 is prevented, and on the other hand for connection between vent openings 81 and vent conduits 82. As is visible in particular from FIGS. 24 to 26, vent chambers 86 are of cuboidal configuration. Vent chambers 86 are connected communicatively to vent conduit 82 (not apparent from FIGS. 24 to 26).

Figure 26:
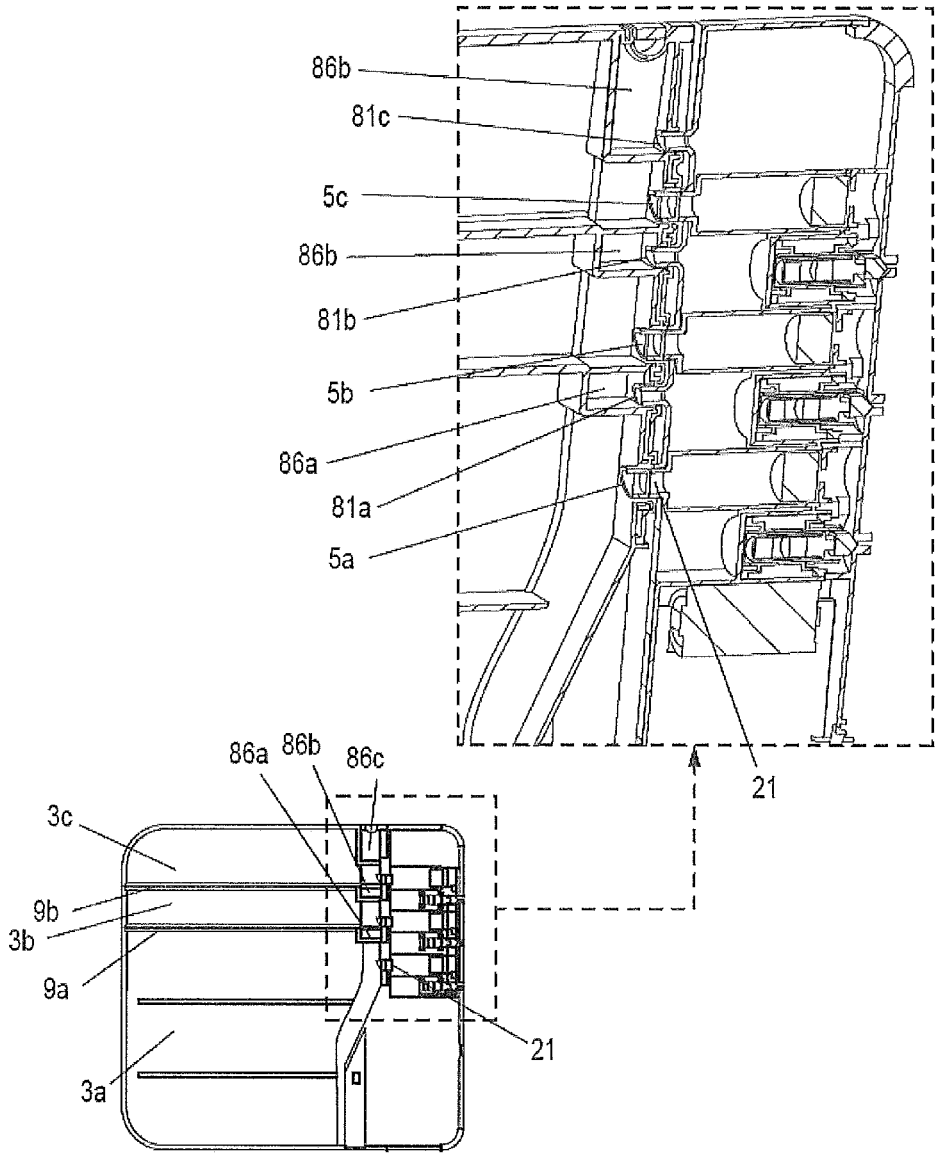
FIG. 26 Longitudinal sectioned view of a three-chamber cartridge coupled to the dispenser.

FIG. 26 is a cross-sectional view of cartridge 1 and the dispenser in the coupled state. It is evident that when dispenser 2 and cartridge 1 are in the coupled state, inlets 21 of peg-like configuration project into the interior of cartridge chambers 3 or vent chambers 86, peg-like inlets 21 in particular of dispenser 2 embodying a liquid-tight connection with outlet openings 5 of the cartridge so that preparation can travel out of chambers 3 only through the interior of the peg-like inlets 21 into dispenser 2. As is further easily seen from FIG. 26, outlet openings 5*a* to 5*c* and vent openings 81*a* to 81*c* lie on one line, each outlet opening 5*a* to 5*c* having a corresponding vent opening 81*a* to 81*c* associated with it.

Figure 27:
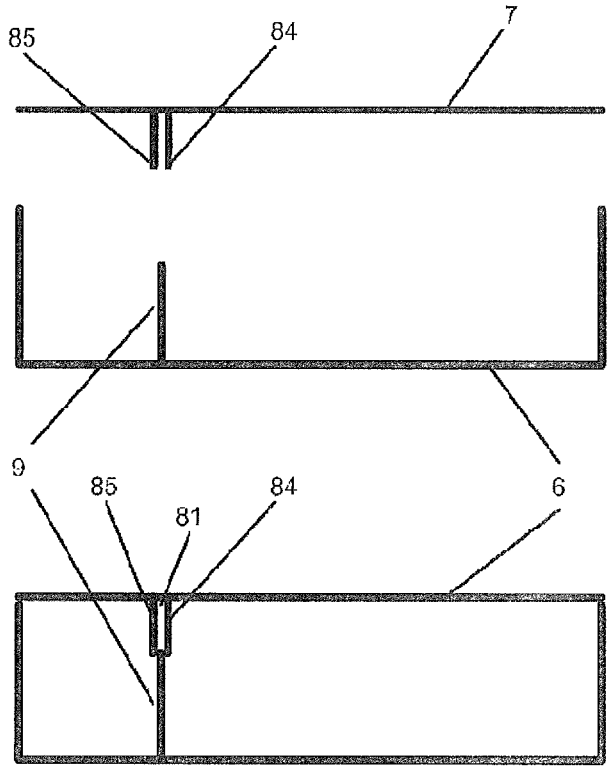
FIG. 27 Schematic diagram of configuration of the vent conduit on a separating web of the cartridge.

FIG. 27 schematically depicts the shaping of a vent conduit by joining two cartridge elements 6, 7. In the upper part of FIG. 27, the two cartridge elements 6, 7 are illustrated in the state separated from one another. Cartridge element 7 is of plate-like configuration, two webs 84, 85 spaced apart from one another extending perpendicular to cartridge element 7. Webs 84, 85 are configured so that they can surround a web 9 shaped on cartridge element 6; this is visible in the lower part of FIG. 27. The fit is selected so that the inner sides of webs 84, 85 slightly touch web 9. With cartridge elements 6, 7 in the assembled state, the two webs 84, 85 and web 9 form vent conduit 81. It is particularly advantageous to connect the ends of webs 84, 85 to web 9 by material attachment, in particular by welding. Mirror welding and/or laser welding have proven particularly advantageous in this context.

Figure 28:
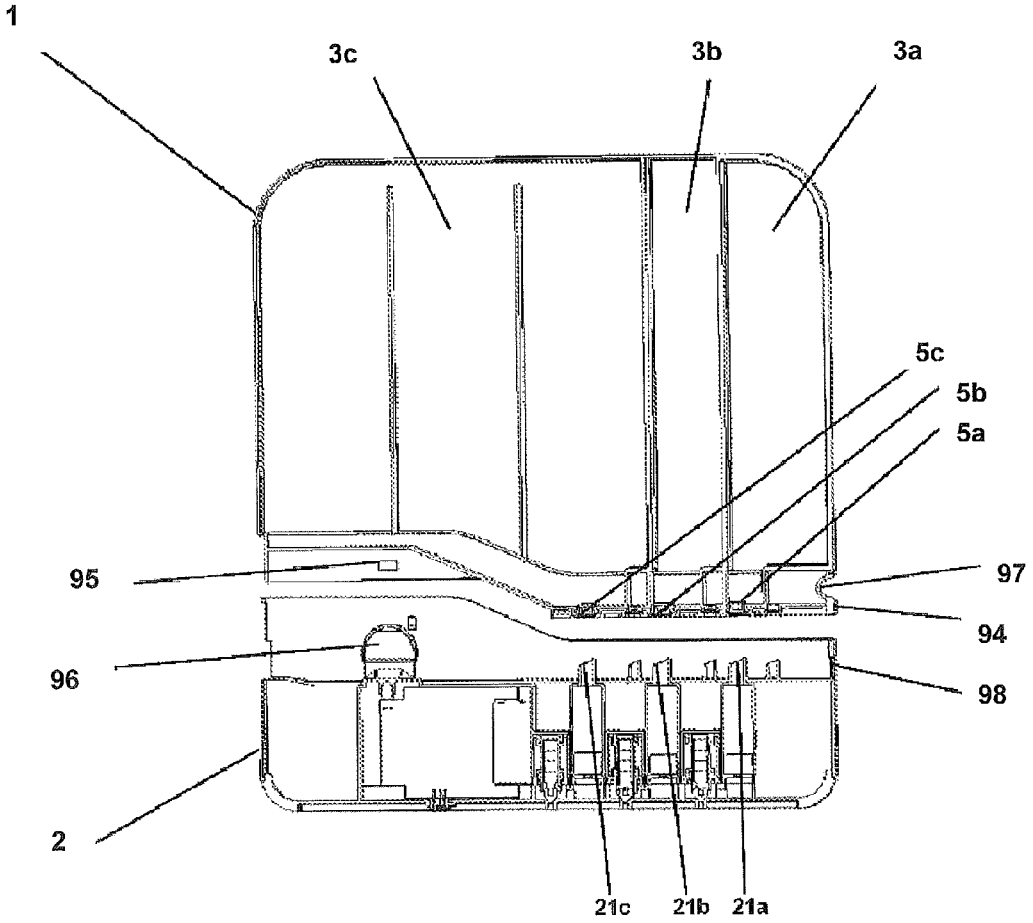
FIG. 28 Cross-sectional view of cartridge and dispenser in the uncoupled state.
Figure 29:
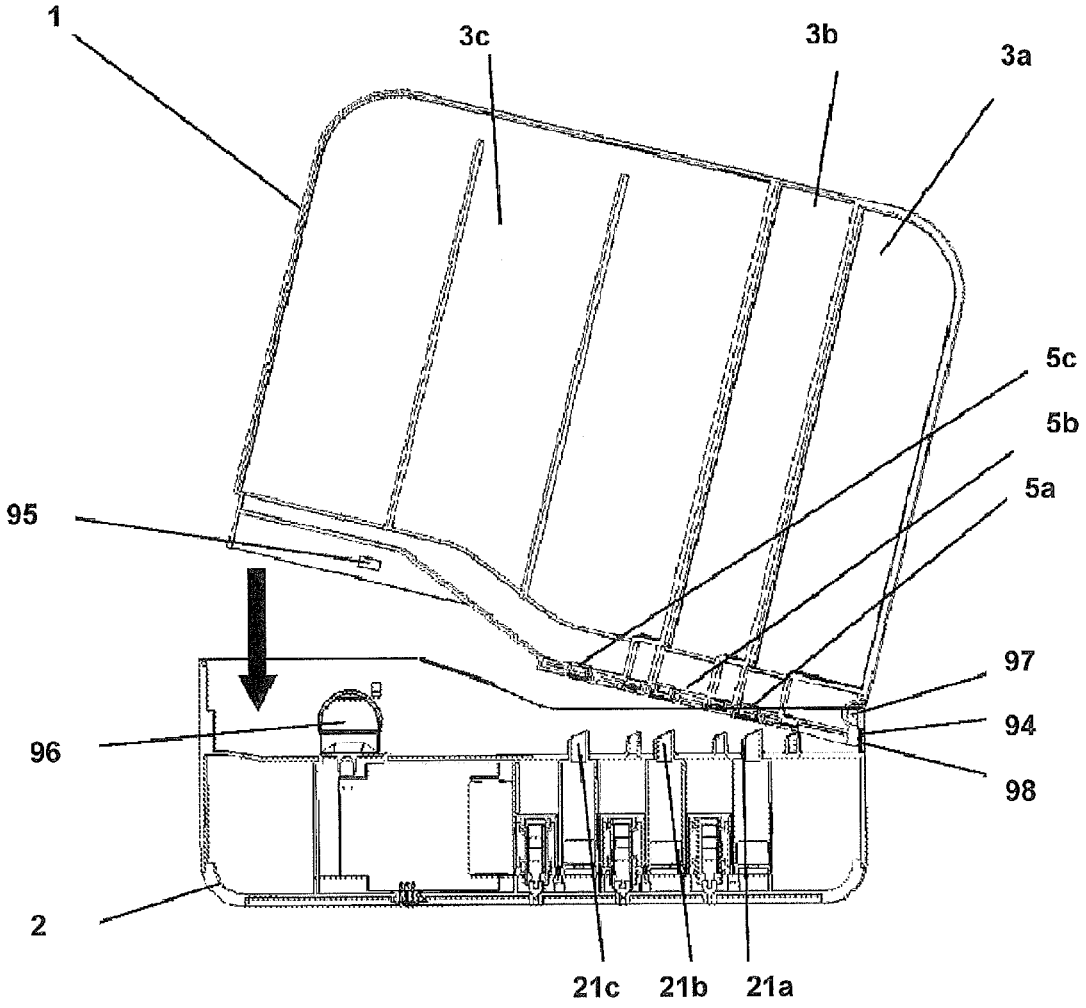
FIG. 29 Cross-sectional view of cartridge and dispenser in the pivotable, latched-in state.

In FIG. 28, dispenser 2 and cartridge 1 are shown in the uncoupled state. Indentation 97 in cartridge 1 below outer chamber 3*a* is evident. Indentation 97 is of approximately semicircular configuration and comprises a shoulder 94 at its bottom end. Indentation 97 and shoulder 94 are configured such that shoulder 94 can be introduced, by a pivoting movement of cartridge 1 upon coupling of cartridge 1 to dispenser 2, into a recess 98 of dispenser 2. This is shown by way of example in FIG. 29. As a result of the detachable connection between the dispenser-side recess 98 and the cartridge-side shoulder 94, cartridge 1 is pivotably secured upon coupling of cartridge 1 to dispenser 2 as a result of the indicated pivoting movement (arrow). It is apparent that upon coupling as a result of the pivoting movement around the connection of recess 98 and shoulder 94, sequential opening or coupling of outlet openings 5*a*, 5*b*, 5*c* and vent openings 81 takes place. Firstly, upon initial coupling of cartridge 1 and dispenser 2 by pivoting, a vent opening 81*a* to 81*c* is thus opened, before the associated outlet opening 5*a* to 5*c* is penetrated. After completion of the pivoting movement, snap-in elements 95 and 96 on cartridge 1 and on dispenser 2 secure cartridge 1 in the coupled position. Snap-in elements 95, 96 are configured such that the latched connection is releasable by the user; for example, cartridge 1 and dispenser 2 can be released from one another again by pushing together the clamp-like snap-in element 96 and by means of a pivoting movement around the connection between recess 98 and shoulder 94.

While at least one exemplary embodiment has been presented in the foregoing detailed description of the invention, it should be appreciated that a vast number of variations exist. It should also be appreciated that the exemplary embodiment or exemplary embodiments are only examples, and are not intended to limit the scope, applicability, or configuration of the invention in any way. Rather, the foregoing detailed description will provide those skilled in the art with a convenient road map for implementing an exemplary embodiment of the invention, it being understood that various changes may be made in the function and arrangement of elements described in an exemplary embodiment without departing from the scope of the invention as set forth in the appended claims and their legal equivalents.

What is claimed is:

1. A cartridge for use in water-conveying household appliances, comprising an enzyme-containing preparation that contains at least one enzyme protein and has a specific heat capacity $c_p$ at 20° C. of less than 3.8 J/(g*K), preferably less than 3.0 J/(g*K), and is stocked in a cartridge or cartridge chamber having an internal volume of between 20 and 500 ml and an average wall thickness of between 0.1 and 2 mm, and wherein the cartridge material has a specific heat capacity $c_p$ at 20° C. of between 1 and 2 J/(g*K).

2. The cartridge according to claim 1, wherein the enzyme-containing preparation contains at least 0.005 wt % of at least one enzyme protein.

3. The cartridge according to claim 1, wherein one or more enzyme protein(s) are selected from the group of the amylases, proteases, cellulases, and/or lipases.

4. The cartridge according to claim 1, wherein at least two are provided in ora cartridge, preparations differing from one another being stocked in the chambers.

5. The cartridge according to claim 1, wherein the cartridge material of the chamber(s) that contain(s) no enzyme protein has/have a specific heat capacity $c_p$ at 20° C. of between 1 and 2 J/(g*K).

6. The cartridge according to claim 1, wherein the preparations in the chamber(s) that contain(s) no enzyme protein has/have a specific heat capacity $c_p$ at 20° C. of less than 3.8 J/(g*K).

7. The cartridge according to claim 1, wherein the preparations in the chamber(s) that contain(s) no enzyme protein are one or more preparation(s) selected from the group of the bleach-containing preparations, surfactant-containing preparations, rinse aid-containing preparations, fabric softener-containing preparations, and/or scent preparations.

8. The cartridge according to claim 1, wherein the cartridge is embodied in substantially plate-like fashion.

9. The cartridge according to claim 1, wherein the ratio of the depth (T) of the cartridge to the width (B) of the cartridge is equal to approximately at least 1:5.

10. The cartridge according to claim 1, wherein the chambers of the cartridge are arranged substantially next to one another.

11. The cartridge according to claim 1, wherein the cartridge is constituted from a substantially transparent plastic.

12. The cartridge according to claim 1, wherein the preparations stocked in the cartridge are substantially transparent.

13. The cartridge according to claim 1, wherein the cartridge is embodied asymmetrically in such a way that the cartridge is couplable to a corresponding dispenser only in one predefined position.

14. The cartridge according to claim 1, wherein the enzyme protein-containing chamber is arranged between two chambers of the cartridge that contain no enzyme protein.

15. The cartridge according to claim 1, wherein the enzyme protein-containing chamber is embodied in terms of its internal volume to be smaller or equal in size with reference to the respectively adjacent chamber.

16. The cartridge according to claim 1, wherein the cartridge and the preparation(s) stocked in the cartridge is/are configured for use in a dishwasher, laundry dryer, and/or washing machine.

* * * * *